US007145522B2

(12) United States Patent
Yamamoto et al.

(10) Patent No.: US 7,145,522 B2
(45) Date of Patent: Dec. 5, 2006

(54) PLASMA DISPLAY DEVICE HAVING IMPROVED LUMINOUS EFFICACY

(75) Inventors: Kenichi Yamamoto, Higashimurayama (JP); Keizo Suzuki, Kodaira (JP); Masatoshi Shiiki, Musashimurayama (JP); Kyoji Kariya, Yokohama (JP); Tomokatsu Kishi, Yamato (JP); Tetsuya Sakamoto, Kawasaki (JP); Takashi Sasaki, Hiratsuka (JP); Takayuki Shimizu, Kunitomi (JP)

(73) Assignees: Hitachi, Ltd., Tokyo (JP); Fujitsu Hitachi Plasma Display Limited, Kawasaki (JP)

( * ) Notice: Subject to any disclaimer, the term of this patent is extended or adjusted under 35 U.S.C. 154(b) by 467 days.

(21) Appl. No.: 10/649,725

(22) Filed: Aug. 28, 2003

(65) Prior Publication Data

US 2004/0257304 A1 Dec. 23, 2004

(30) Foreign Application Priority Data

Jun. 18, 2003 (JP) ..... 2003-173647

(51) Int. Cl.
*G09G 3/28* (2006.01)

(52) U.S. Cl. ..... 345/60; 345/66; 315/169.1

(58) Field of Classification Search ..... 345/60–67; 315/169.1, 169.3, 169.4
See application file for complete search history.

(56) References Cited

U.S. PATENT DOCUMENTS 6,867,552 B1 * 3/2005 Takamori et al. ..... 315/169.4
6,900,781 B1 5/2005 Mori et al.
2002/0008680 A1 1/2002 Hashimoto et al.
2003/0173903 A1 * 9/2003 Takeuchi et al. ..... 315/169.2
2003/0179160 A1 9/2003 Yamamoto et al.
2003/0218432 A1 * 11/2003 Song et al. ..... 315/169.1
2004/0001035 A1 * 1/2004 Awamoto et al. ..... 345/60
2004/0095295 A1 5/2004 Nagao et al.

FOREIGN PATENT DOCUMENTS

JP 11-109914 4/1999
JP 11-282416 10/1999

(Continued)

OTHER PUBLICATIONS

Journal of Applied Physics, vol. 88, No. 10, Nov. 15, 2000, "Theoretical formulation of the vacuum ultraviolet production efficiency in a plasma display panel", K. Suzuki et al, pp. 5605-5611.

(Continued)

*Primary Examiner*—Richard Hjerpe
*Assistant Examiner*—Kimnhung Nguyen
(74) *Attorney, Agent, or Firm*—Mattingly, Stanger, Malur & Brundidge, P.C.

(57) ABSTRACT

There is provided a plasma display device capable of high luminous efficacy and stable driving for displaying images at various image display load factors. The plasma display device performs the sustain discharge for a light-emission display, and is configured to apply a sustain pulse voltage between a sustain electrode pair in a respective one of the plural discharge cells to generate a sustain discharge in a respective one of the following operating modes selected based upon use of the plasma display device: (a) generating a pre-discharge and then a main discharge; (b) generating a main discharge without a pre-discharge preceding the main discharge; and (c) switching between the mode (a) and the mode (b). The sustain voltage waveforms are used which compensate for an increase in voltage drop due to an increase in discharge current when the image display load factor is excessively increased.

24 Claims, 21 Drawing Sheets

FOREIGN PATENT DOCUMENTS

| | | |
|---|---|---|
| JP | 2002-72959 | 3/2002 |
| JP | 2002-108273 | 4/2002 |
| JP | 2002-132215 | 5/2002 |
| JP | 2002-215084 | 7/2002 |

OTHER PUBLICATIONS

SID 01 DIGEST, 40.4: A New Driving Technology for PDPs with Cost Effective Sustain Circuit, T. Kishi et al, pp. 1236-1239.

* cited by examiner

PLASMA DISPLAY DEVICE HAVING IMPROVED LUMINOUS EFFICACY

BACKGROUND OF THE INVENTION

1. Field of the Invention

The present invention relates to a plasma display device employing a plasma display panel (hereinafter referred to as a PDP). In particular, the present invention is useful for improving luminous efficacy of the PDP and driving the PDP stably.

2. Description of the Prior Art

Recently, plasma TV (PDP-TV) receivers, a kind of plasma display devices employing the plasma display panel (PDP), have been spreading rapidly in the market for large-screen TV receivers.

FIG. 14 is an exploded perspective view illustrating an example of a conventional ac surface-discharge type PDP of a three-electrode structure.

In the ac surface-discharge type PDP shown FIG. 14, a discharge space 63 is formed between a pair of opposing glass substrates, a front substrate 51 and a rear substrate 58. Usually, the discharge space 33 is filled with a discharge gas at several hundreds Torrs or more. As the discharge gas, usually He, Ne, Xe, and Ar are used either alone or in combination with one or more of the others.

Disposed on the lower surface of the front substrate 51 serving as a display screen are a plurality of sustain electrode pairs (also called sustain-discharge electrode pairs) for formation of sustain discharge mainly for light emission for forming a display. Each of these sustain electrode pairs is composed of an X electrode and a Y electrode.

Usually, each of the X and Y electrodes is made of a combination of a transparent electrode and an opaque electrode for supplementing conductivity of the transparent electrode. The X electrodes 64-1, 64-2, . . . are comprised of transparent X electrodes 52-1, 52-2, . . . and corresponding opaque X bus electrodes 54-1, 54-2, . . . , respectively, and the Y electrodes 65-1, 65-2, . . . , are comprised of transparent Y electrodes 53-1, 53-2, . . . and corresponding opaque Y bus electrodes 55-1, 55-2, . . . , respectively. It is often that the X electrodes are used as a common electrode and the Y electrodes are used as independent electrodes.

Usually, a discharge gap Ldg between the X and Y electrodes in one discharge cell are designed to be small such that a discharge start voltage is not excessively high, and a spacing Lng between an X electrode of one of two adjacent discharge cells and a Y electrode of the other of the two adjacent discharge cells is designed to be large such that unwanted discharge is prevented from occurring between two adjacent cells.

The X and Y sustain electrodes are covered with a front dielectric 56 which, in turn, is covered with a protective film 57 made of material such as magnesium oxide (MgO). The MgO protects the front dielectric 56 and lowers a discharge start voltage because of its high sputtering resistance and high secondary electron emission yield.

Address electrodes (also called write electrodes, address-discharge electrodes, or A electrodes) 59 for generating an address discharge (also called a write discharge) are arranged on the upper surface of the rear substrate 58 in a direction perpendicular to the sustain electrodes (the X and Y electrodes). The address electrodes 59 are covered with a rear dielectric 60, and barrier ribs 61 are disposed between the address electrodes 59 on the rear dielectric 60. Phosphors 62 are coated in cavities formed by the wall surfaces of the barrier ribs 61 and the upper surface of the rear dielectric 60.

In this configuration, an intersection of a sustain electrode pair with an address electrode corresponds to one discharge cell, and the discharge cells are arranged in a two-dimensional fashion. In a color PDP, a trio of three kinds of discharge cells coated with red, green and blue phosphors, respectively, forms one pixel.

FIG. 15 and FIG. 16 are cross-sectional views of one discharge cell shown in FIG. 14 viewed in the directions of the arrows D1 and D2, respectively. In FIG. 16, the boundary of the cell is approximately represented by broken lines. In FIG. 16, reference numeral 66 denote electrons, 67 is a positive ion, 68 is a positive wall charge, and 69 are negative wall discharges.

Next operation of the PDP of this example will be explained.

The principle of generation of light by the PDP is such that discharge is started by a voltage pulse applied between the X and Y electrodes, and then ultraviolet rays generated by excited discharge gases are converted into visible light by the phosphor.

FIG. 17 is a block diagram illustrating a basic configuration of a plasma display device. The PDP (also called the plasma display panel or the panel) 91 is incorporated into the plasma display device 100. The PDP 91 is connected to a driving circuit 98 comprised of an X electrode driving circuit 95, a Y electrode driving circuit 96 and an address electrode driving circuit 97 for supplying voltages to the X, Y and address electrodes, via an X electrode terminal portion 92, a Y electrode terminal portion 93 and an address electrode terminal portion 94 which serve as connecting portions between the electrodes within the panel and external circuits, respectively. The driving circuit 98 receives video signals for a display image from a video signal source 99, converts the signals into driving voltages, and then supplies them to respective electrodes of the PDP 91.

FIGS. 18A–18C illustrate a concrete example of driving voltages in a case where the ADS (Address Display-Period Separation) system is employed for displaying gray scales.

FIG. 18A is a time chart illustrating driving voltages during one TV field required for displaying one picture on the PDP shown in FIG. 14. FIG. 18B illustrates waveforms of voltages applied to the address electrode 59, the X electrode 64 and the Y electrode 65 during the address period (also called the address-discharge period, or the write-discharge period)80 shown in FIG. 18A. The X and Y electrodes are called the sustain electrodes, respectively, and they are referred to collectively as the sustain electrode pair.

FIG. 18C illustrates sustain pulse voltages (also called the sustain-electrode pulse driving voltages or the sustain discharge voltages) applied between all the X electrodes and all the Y electrodes, which are the sustain electrodes, simultaneously, and a voltage (an address voltage) applied to the address electrodes, during a sustain period (also called a sustain-discharge period, or a light-emission display period) 81 shown in FIG. 18A.

Portion I of FIG. 18A illustrates that one TV field 70 is divided into sub-fields 71 to 78 each having different plural numbers of light emission from one another. Gray scales are generated by a combination of one or more selected from among the sub-fields 71 to 78.

For example, in a case where each of the eight sub-fields is provided with a luminance weighted by a different weighting factor based upon the binary system, each of three primary-color emitting discharge cells provides $2^8$ (256) gray scale levels of luminance, and the PDP is capable of producing about 16.78 millions of different colors.

Portion II of FIG. 18A illustrates that each sub-field comprises a reset period (also called a reset-discharge period) 79 for resetting the discharge cells to an initial state, an address period (also called an address-discharge period, or a write-discharge period) 80 for addressing discharge cells to be lighted and made luminescent, and a sustain period (also called a sustain-discharge period, or a light-emitting display period) 81.

FIG. 18B illustrates waveforms of voltages applied to the address electrode 59, the X electrode 64 and the Y electrode 65 during the address period 80 shown in FIG. 18A, and the waveforms are called the sustain pulse voltage waveforms. A waveform (an A waveform) 82 represents a voltage V0 (V) applied to one of the address electrodes 59 during the address period 80, a waveform (an X waveform) 83 represents a voltage V1 (V) applied to the X electrode 64, and waveforms (Y waveforms) 84 and 85 represent voltages V21 (V) and V22 (V) applied to ith and (i+1)th Y electrodes 65.

As shown in FIG. 18B, when a scan pulse 86 is applied to the ith Y electrode 65, in a cell located at an intersection of the ith Y electrode with the address electrode 59 supplied with the voltage V0, initially an address discharge occurs between the Y electrode and the address electrode, and then an address discharge occurs between the Y electrode and the X electrode. No address discharges occur at cells located at intersections of the Y electrodes with the address electrode 59 at ground potential. This applies to a case where a scan pulse 87 is applied to the (i+1)th Y electrode.

As shown in FIG. 16, in the cell where the address discharge has occurred, charges (wall discharges) are generated by the discharges on the surface of the dielectric film 56 and the protective film 57 covering the X and Y electrodes, and consequently, a wall voltage Vw (V) is produced between the X and Y electrodes. In FIG. 16, reference numeral 66 denote electrons, 67 is a positive ion, 68 is a positive wall charge, and 69 are negative wall charges. Occurrence of sustain discharge during the succeeding sustain period 81 depends upon the presence of this wall charge.

FIG. 18C illustrates sustain pulse voltages applied between all the X electrodes and all the Y electrodes which serve as the sustain electrodes simultaneously during the sustain period 81 shown in FIG. 18A.

The X electrodes are supplied with a sustain pulse voltage of a voltage waveform 88, the Y electrodes are supplied with a sustain pulse voltage of a voltage waveform 89, and the magnitude of the voltages of the waveforms 88 and 89 is V3 (V). The address electrode 59 is supplied with a driving voltage of a voltage waveform 90 which is kept at a fixed voltage V4 during the sustain period 81. The voltage V4 may be selected to be ground potential.

The sustain pulse voltage of the magnitude V3 is applied alternately to the X electrode and the Y electrode, and as a result reversal of the polarity of the voltage between the X and Y electrodes is repeated. The magnitude V3 is selected such that the presence and absence of the wall voltage generated by the address discharge correspond to the presence and absence of the sustain discharge, respectively.

In the discharge cell where the address discharge has occurred, discharge is started by the first sustain voltage pulse applied to one of the X and Y electrodes, and the discharge continues until wall charges of the opposite polarity accumulate to some extent. The wall voltage accumulated due to this discharge serves to reinforce the second voltage pulse applied to the other of the X and Y electrodes, and then discharge is started again. The above is repeated by the third, fourth and succeeding pulses.

In this way, in the discharge cell where the address discharge has occurred, sustain discharges occur between the X and Y electrodes the number of times equal to the number of the applied voltage pulses and thereby emit light. On the other hand, in the discharge cells where the address discharge has not occurred, the discharge cells do not emit light. The above are the basic configuration of the conventional plasma display device and a conventional driving method thereof.

The following are some principal techniques for improving the luminous efficacy in the plasma display devices and driving the plasma display devices stably.

(1) Japanese Patent Application Laid-Open No. 2002-72959 (laid open on Mar. 12, 2002) and Japanese Patent Application Laid-Open No. 2002-108273 (laid open on Apr. 10, 2002)

If a sustain voltage is lowered to reduce electric power consumed for light emission, i.e., to improve luminous efficacy, the amount of wall charges accumulated after light-emitting discharge is reduced, and as a result the sustain discharge is not maintained because the discharge voltage is not exceeded even when the subsequent sustain voltage is applied. Consequently, the light-emitting discharge is discontinued, and therefore the quality of displayed images are severely degraded. To solve this problem, in the above prior art (1), after lighting discharge cells by applying conventional sustain voltages, by increasing an absolute value of a voltage difference between the sustain electrode pair, the stable sustain discharge is produced when the sustain voltages are lowered to improve the luminous efficacy. However, there is a problem in that the luminance become lower than in the case of the conventional driving method, because the discharge is produced at lower voltages.

(2) Japanese Patent Application Laid-Open No. 2002-132215 (laid open on May 9, 2002)

In the conventional driving method and the above prior art (1), a discharge cell is made to generate a discharge only once for one sustain pulse, and discontinues discharging until the subsequent sustain pulse is applied. In the initial discharge, a current sufficient for the discharge is supplied, but the amount of produced ultraviolet rays saturates as the discharge current is increased, further, the intensity of visible light also saturates as the amount of the ultraviolet rays is increased, and therefore luminance hardly increases as the discharge current is increased. Further, if the discharge cell is driven at a current small enough to prevent saturation of luminance, the discharge itself becomes unstable, and consequently, the stable discharges cannot be repeated. The PDP needs to vary a lighted-discharge-cell ratio (an display-image-forming discharge cell ratio or a load factor) according to various images to be displayed on the PDP, and hence the required discharge currents also vary. Consequently, if the discharge cells are driven at lower current levels, the more unstable the discharges become.

The above prior art (2) applies a two-level voltage to the sustain electrodes such that initially a first discharge occurs and then a second discharge occurs, for the purpose of repeating the discharges stably and improving the luminous efficacy at the same time regardless of variations in the lighted-discharge-cell ratio. Further, the prior art (2) also varies timing of succeeding rise of the sustain pulses or the repetition periods of the sustain pulses according to the lighted-discharge-cell ratio of each of the sub-fields, and increases or decreases finely the number of the sustain pulses to retain continuity between luminances before and after the changeover of the sustain pulse waveforms according to the lighted-discharge-cell ratio. The first discharge utilizes an LC resonance of a panel capacitance Cp and an inductance Lr of a coil included in an electric power recovery circuit for recovering the capacitive current from the PDP into a capacitor and then releasing the capacitive current. That is to say, the first discharge occurs in a process in which the LC resonance causes the voltage to rise to its maximum and then to fall from its maximum to its minimum. In the process for the voltage to fall from its maximum to its minimum, at an instant when the first discharge starts to weaken, the saturation of the amount of the produced ultraviolet rays starts to be decreased by the limitation on the current, and thereafter, since the degree of saturation of the amount of produced ultraviolet rays for increasing discharge current is decreased, the luminous efficacy is improved. However, since the coil of the electric power recovery circuit is utilized, a complicated measure which increases or decreases finely the number of the sustain pulses was required to retain continuity between luminances before and after the changeover of the sustain pulse waveforms according to the lighted-discharge-cell ratio of each of the subfields.

SUMMARY OF THE INVENTION

Improvement in luminous efficacy is still the most important problem for the PDP. The present invention provides a technique capable of improving the luminous efficacy of the sustain discharge by improving a driving method of the plasma display panel, and at the same time facilitating the stable driving for various load factors in displaying images, in the plasma display devices such as plasma TV receivers (PDP-TV) employing the plasma display panel.

First, the following will explain the basic mechanism of the improvement in luminous efficacy upon which the principle of the driving method of the present invention is based. The basic physical principle in increasing of the luminous efficacy is such that, in the case of discharge in a weak electric field (a low discharge-space voltage), an electron temperature is lowered, and therefore the ultraviolet ray production efficiency is increased. The increase in ultraviolet ray production efficiency naturally increases the luminous efficacy. That is to say, the basics in this technique is lowering of the discharge-space voltage in discharge. Here, the discharge-space voltage is an absolute value of a difference between a surface potential of a dielectric over the X electrode and that over the Y electrode, and is a voltage actually applied in the discharge space. That is to say, the discharge-space voltage is a sum of a voltage applied between the sustain electrodes and a wall voltage produced between the dielectrics over the X and Y electrodes. The relationship itself between the discharge-space voltages and the production of ultraviolet rays is disclosed in J. Appl. Phys. 88, p. 5605 (2000).

The basic concept of the present invention is as follows:

(1) Producing the sustain discharge in at least two steps including a pre-discharge and a main discharge succeeding the pre-discharge, which will be hereinafter referred to as a two-step sustain discharge, or as a two-step discharge in short); and (2) Carrying out the two-step discharge by basing upon properties of driving voltage (sustain voltage and address voltage) waveforms.

Here, periods when a voltage of a desired magnitude Vs or more is externally applied to the sustain electrodes are called sustain-pulse-applied periods, and sustain periods other than the sustain-pulse-applied periods are called sustain-pulse-open periods.

Therefore, the discharge-space voltage in the pre-discharge is mainly a wall voltage which has been produced during the preceding discharge, and as a result this realizes a discharge providing a high luminous efficacy at the low discharge-space voltage. Further, in the main discharge succeeding the pre-discharge, since the wall voltage is lowered by the pre-discharge, this realizes a main discharge providing a high luminous efficacy at the lower discharge-space voltage than in the prior art. The reason why the main discharge occurs at the low discharge-space voltage is that the space charge generated by the pre-discharge produces priming effects.

In one of the present inventions, to produce the pre-discharge at the low discharge-space voltage, an appropriate voltage (a voltage for starting the pre-discharge, or an intermediate voltage) is applied between the sustain electrodes during the sustain-pulse-open period, and this method is called the sustain-modulation driving method. In another of the present inventions, to produce the pre-discharge at the low discharge-space voltage, the address electrode is supplied with a pulse voltage which rises in the sustain-pulse-open period such that an appropriate voltage (a voltage for starting the pre-discharge) is generated between the address electrode and one of the sustain electrodes, and this method is called the address-modulation driving method. Further, the above two methods may be combined to perform the two-step discharge driving method.

The above-mentioned intermediate voltage can be provided by a power supply or grounding. To ensure the stable driving when the load factors in displaying images on the PDP vary, a means (a voltage drop compensating means) is provided which compensates for an increase in voltage drop caused by an increase in discharge current when the load factors increase. As the voltage drop compensating means, a means (a wall charge accumulating means) is provided which accumulates many wall charges after the start of discharge by one sustain pulse or after the discharge. The wall charge accumulating means lengthens the sustain-pulse-applied period, or adds a voltage pulse which rises after the start of a main discharge generated by one sustain pulse or after the discharge, or adds a voltage pulse which rises after a main discharge generated by one sustain pulse. Further, as another voltage drop compensating means, one or both of the sustain voltage Vs and the intermediate voltage Vp may be increased when the load factors increase.

The load factor is the ratio of the number of lighted discharge cells to the number of all the discharge cells included in the panel, at a given time. However, the load factor sometimes means the ratio of the number of lighted discharge cells arranged in a line in a direction of a given sustain electrode pair to the number of all the discharge cells arranged in the line.

As described above, at least two kinds of driving voltage waveforms (sustain pulse voltage waveforms, address voltage waveforms, and conventional waveforms) are utilized according to the load factors.

At load factors at the boundary between two different driving voltage waveforms, the two luminances produced by the discharges generated by the two waveforms are made approximately equal to each other to ensure continuity of the two luminances. Here, "approximately equal" means the degree of discontinuity between the two luminances which does not appear unnatural to the human eye.

The following explains the summaries of the representative ones of the inventions disclosed in this specification. The gist of the present inventions lies in the plasma display devices described below.

(1) A plasma display device having a plasma display panel including at least a plurality of discharge cells each having at least a sustain electrode pair for generating sustain discharge for a light emission display, wherein said plasma display device is configured to apply a sustain pulse voltage between said sustain electrode pair in a respective one of said plurality of discharge cells to generate a sustain discharge in a respective one of the following operating modes selected based upon use of said plasma display device: (a) generating a pre-discharge and then a main discharge; (b) generating a main discharge without a pre-discharge preceding said main discharge; and (c) switching between the mode (a) and the mode (b), wherein at least a first-waveform voltage and a second-waveform voltage are provided for use as said sustain pulse voltage, said first-waveform voltage is composed of a first portion having a major portion of a first voltage and a second portion having a major portion of a second voltage higher than said first voltage, said second-waveform voltage is composed of a third portion having a major portion of a third voltage and a fourth portion having a major portion of a fourth voltage higher than said third voltage, said first-waveform voltage and said second-waveform voltage satisfy the following conditions (i) and (ii): (i) at least one of the following inequalities is satisfied: said third voltage>said first voltage, a time duration of said third portion>a time duration of said first portion which includes 0 seconds, and (ii) at least one of the following inequalities is satisfied: said fourth voltage>said second voltage, a time duration of said fourth portion>a time duration of said second portion which includes 0 seconds, wherein said plasma display device is provided with a circuit for switching said sustain pulse voltage from said first-waveform voltage to said second-waveform voltage based upon an increase of an amount of a load factor, where said load factor is a ratio of a number of lighted ones of said plurality of discharge cells during said sustain discharge to a total number of said plurality of discharge cells, and wherein said first and third voltages are established by using at least a switch and one of a power supply and ground potential.

(2) A plasma display device having a plasma display panel including at least a plurality of discharge cells each having at least a sustain electrode pair for generating sustain discharge for a light emission display, wherein said plasma display device is configured to apply a sustain pulse voltage between said sustain electrode pair in a respective one of said plurality of discharge cells to generate a sustain discharge in a respective one of the following operating modes selected based upon use of said plasma display device: (a) generating a pre-discharge and then a main discharge; (b) generating a main discharge without a pre-discharge preceding said main discharge; and (c) switching between the mode (a) and the mode (b), wherein at least a first-waveform voltage and a second-waveform voltage are provided for use as said sustain pulse voltage, said first-waveform voltage is composed of a first portion having a major portion of a first voltage and a second portion having a major portion of a second voltage higher than said first voltage, said second-waveform voltage is composed of a third portion having a major portion of a third voltage and a fourth portion having a major portion of a fourth voltage higher than said third voltage, said first-waveform voltage and said second-waveform voltage satisfy the following conditions (i) and (ii): (i) at least one of the following inequalities is satisfied: said third voltage>said first voltage, a time duration of said third portion>a time duration of said first portion which includes 0 seconds, and (ii) at least one of the following inequalities is satisfied: said fourth voltage>said second voltage, a time duration of said fourth portion>a time duration of said second portion which includes 0 seconds, wherein said plasma display device is provided with a circuit for switching said sustain pulse voltage from said first-waveform voltage to said second-waveform voltage based upon an increase of an amount of a load factor, where said load factor is a ratio of a number of lighted ones of said plurality of discharge cells during said sustain discharge to a total number of said plurality of discharge cells, and wherein two electrodes of said sustain electrode pair are supplied with two voltages opposite in polarity from each other, respectively.

(3) A plasma display device having a plasma display panel including at least a plurality of discharge cells each having at least a sustain electrode pair for generating sustain discharge for a light emission display, wherein said plasma display device is configured to apply a sustain pulse voltage between said sustain electrode pair in a respective one of said plurality of discharge cells to generate a sustain discharge in a respective one of the following operating modes selected based upon use of said plasma display device: (a) generating a pre-discharge and then a main discharge; (b) generating a main discharge without a pre-discharge preceding said main discharge; and (c) switching between the mode (a) and the mode (b), wherein at least a first-waveform voltage and a second-waveform voltage are provided for use as said sustain pulse voltage, said first-waveform voltage is composed of a first portion having a major portion of a first voltage and a second portion having a major portion of a second voltage higher than said first voltage, said second-waveform voltage is composed of a third portion having a major portion of a third voltage and a fourth portion having a major portion of a fourth voltage higher than said third voltage, said first-waveform voltage and said second-waveform voltage satisfy the following conditions (i) and (ii): (i) at least one of the following inequalities is satisfied: said third voltage>said first voltage, a time duration of said third portion>a time duration of said first portion which includes 0 seconds, and (ii) at least one of the following inequalities is satisfied: said fourth voltage>said second voltage, a time duration of said fourth portion>a time duration of said second portion which includes 0 seconds, wherein said plasma display device is provided with a circuit for switching said sustain pulse voltage from said first-waveform voltage to said second-waveform voltage based upon an increase of an amount of a load factor, where said load factor is a ratio of a number of lighted ones of said plurality of discharge cells during said sustain discharge to a total number of said plurality of discharge cells, and wherein said first and third voltages are established by using an inductance coupled to one of a power supply and ground potential.

(4) A plasma display device having a plasma display panel including at least a plurality of discharge cells each having at least a sustain electrode pair for generating sustain discharge for a light emission display and an address electrode for selecting one to be lighted from among said plurality of discharge cells, wherein said plasma display device is configured to apply a sustain pulse voltage between said sustain electrode pair in a respective one of said plurality of discharge cells to generate a sustain discharge in a respective one of the following operating modes selected based upon use of said plasma display device: (a) generating a pre-discharge and then a main discharge; (b) generating a main discharge without a pre-discharge preceding said main discharge; and (c) switching between the mode (a) and the mode (b), wherein said address electrode is supplied with an address pulse voltage synchronized with said sustain pulse voltage during said sustain discharge, and said address pulse voltage is increased based upon an increase of an amount of a load factor, where said load factor is a ratio of a number of lighted ones of said plurality of discharge cells during said sustain discharge to a total number of said plurality of discharge cells.

(5) A plasma display device according to one of (1)–(3), wherein a repetition period of said second-waveform is longer than that of said first-waveform.

(6) A plasma display device according to one of (1)–(3), wherein said first-waveform and second-waveform voltages include post-discharge voltages higher than said second and fourth voltages, respectively.

(7) A plasma display device according to one of (1)–(3), wherein said plasma display device further comprises a circuit for calculating said load factor and a control circuit for selecting one of said first-waveform and second-waveform voltages based upon said load factor.

(8) A plasma display device according to (4), wherein said plasma display device further comprises a circuit for calculating said load factor and a control circuit for controlling said address pulse voltage based upon said load factor.

(9) A plasma display device according to (7) or (8), wherein said sustain pulse voltage is selected so as to generate said pre-discharge when said load factor exceeds a predetermined value.

(10) A plasma display device according to (7), wherein said plasma display device further comprises a table listing a relationship among said load factors, numbers of said sustain pulses of said first-waveform and second-waveform voltages, and luminance of said discharge cells, and at a boundary load factor at which a changeover is performed from said first-waveform voltage to said second-waveform voltage, numbers of sustain pulses of said first-waveform and second-waveform voltages are selected by using said table such that two luminances produced by discharges generated by said first-waveform and second-waveform voltages, respectively, are approximately equal to each other.

(11) A plasma display device according to (8), wherein said plasma display device further comprises a table listing a relationship among said load factors, numbers of said sustain pulses of said sustain pulse voltage, said address voltage and luminance of said discharge cells, and at a boundary load factor at which a changeover is performed in said address voltage, said address voltages are selected by using said table such that two luminances produced by discharges generated by said address voltages before and after said changeover, respectively, are approximately equal to each other.

DETAILED DESCRIPTION OF THE PREFERRED EMBODIMENTS

Figure 1:
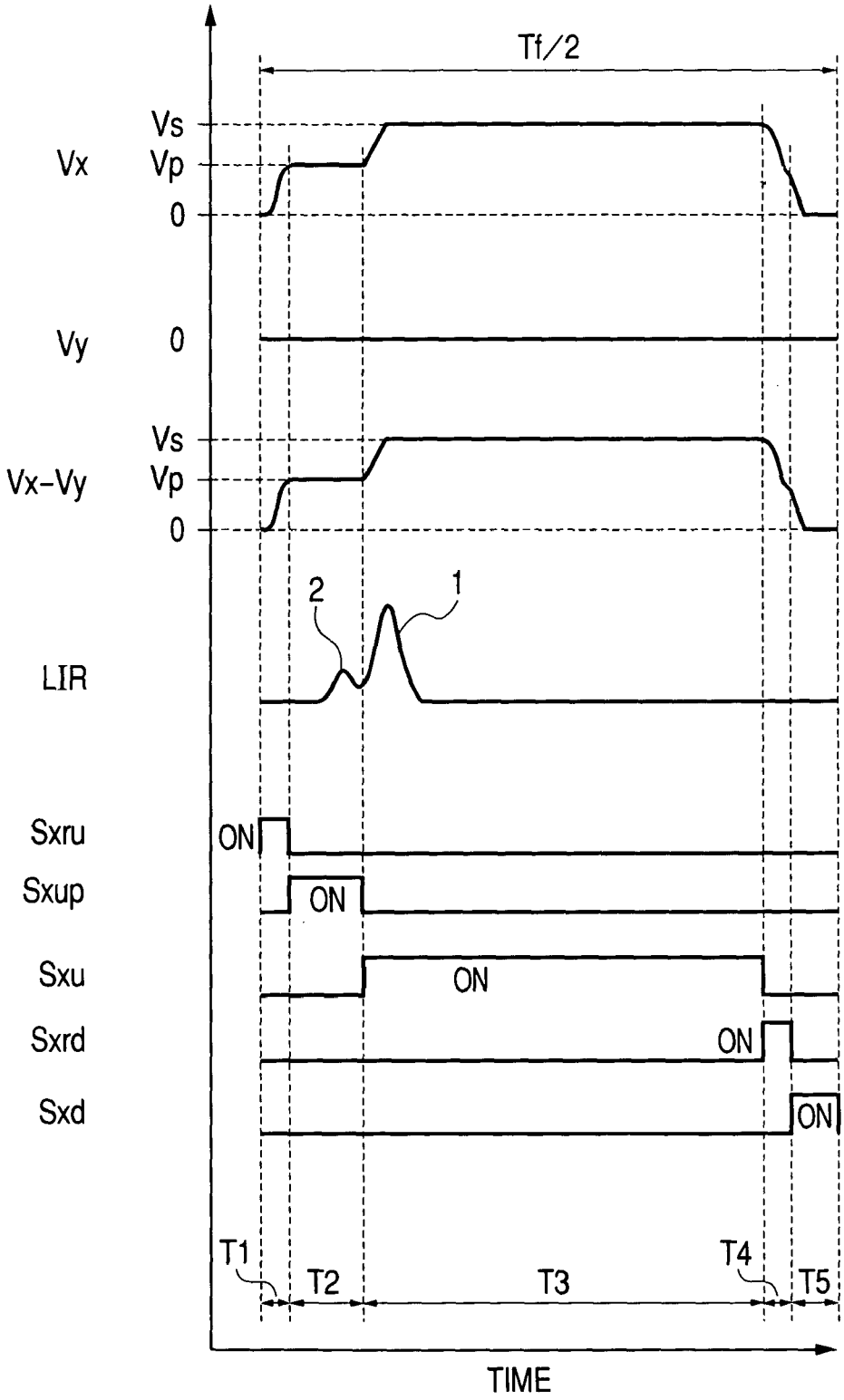
FIG. 1 is a time chart illustrating voltages, a light emission waveform, and input signals to switches during a sustain period in a plasma display device of Example 1 of Embodiment 1 in accordance with the present invention.

In the following, the embodiments in accordance with the present invention will be explained in detail by reference to the drawings. Throughout the figures for explaining the embodiments, the same reference numerals or symbols are used to designate functionally similar parts or portions, and repetition of their explanation is omitted.

Embodiment 1

Figure 2:
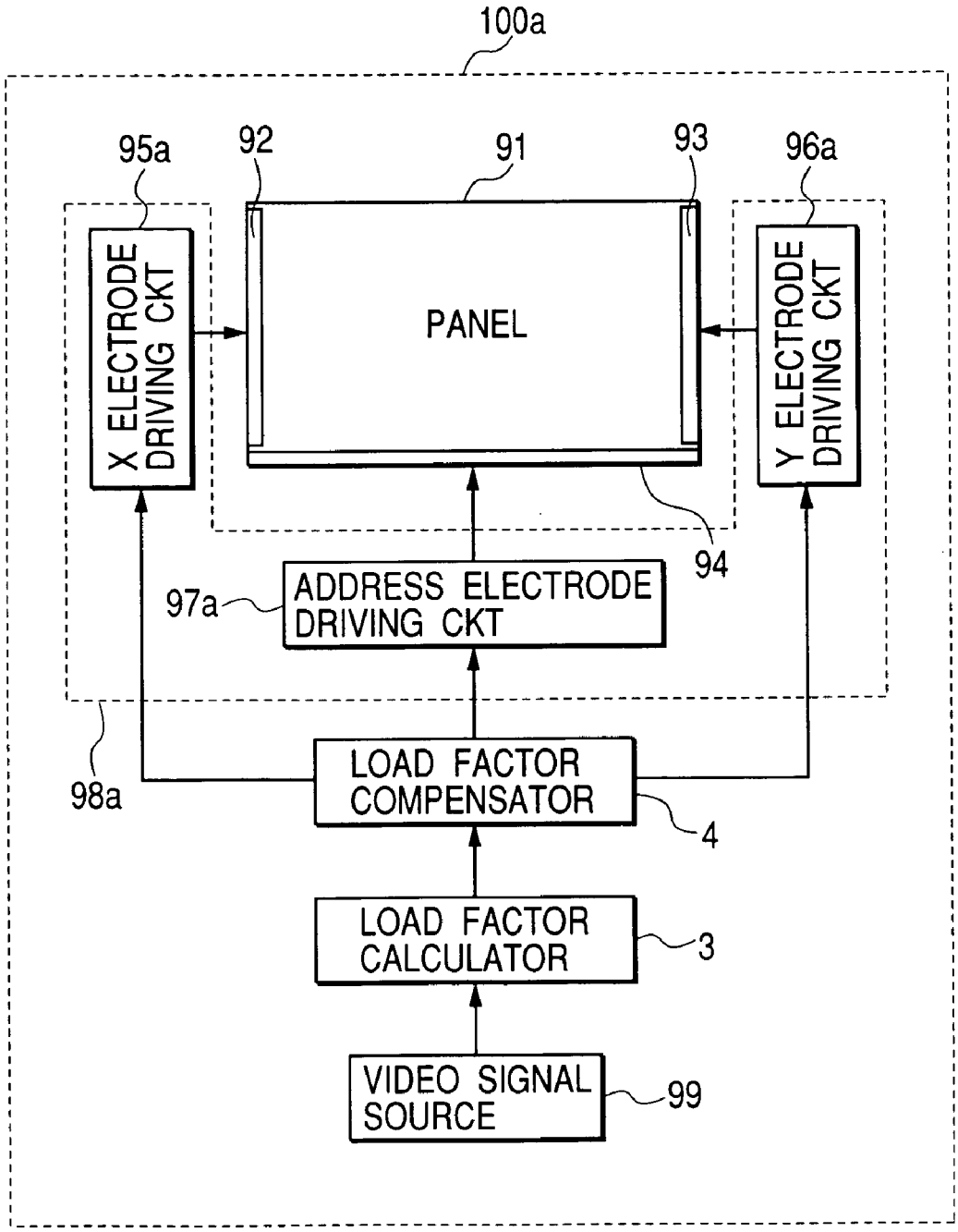
FIG. 2 is a block diagram illustrating a basic configuration of Example 1 of Embodiment 1 in accordance with the present invention.
Figure 3:
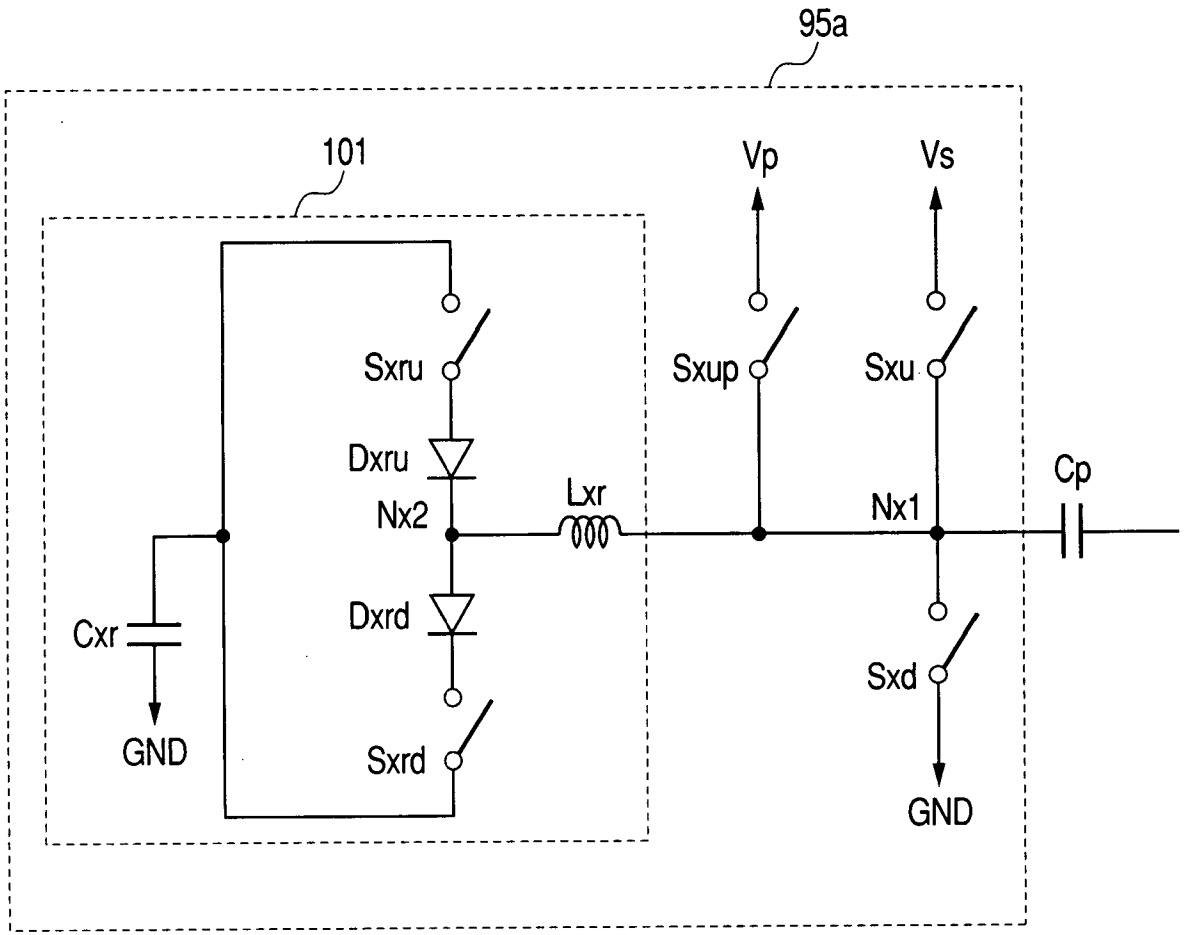
FIG. 3 is a diagram illustrating an X or Y electrode driving circuit of Example 1 of Embodiment 1 in accordance with the present invention.
Figure 18A:
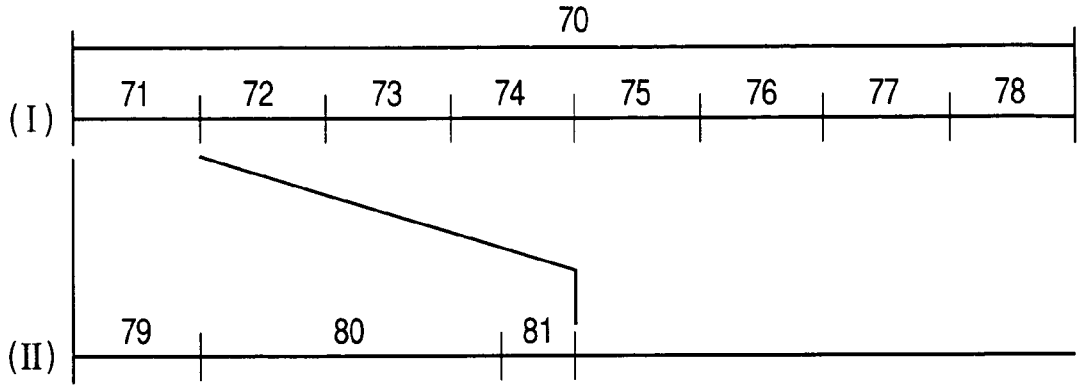
FIGS. 18A–18C are time charts for illustrating operation of driving circuits during one TV field period for displaying one picture on the plasma display panel.

FIG. 1 is a time chart for the sustain period 81 (see FIG. 18A) illustrating sustain pulse waveforms Vx, Vy applied to all the X and Y electrodes serving as the sustain electrodes, respectively, simultaneously, a light emission waveform LIR, and input signals Sxru-Sxd to switches of an X electrode driving circuit 95*a* shown in FIGS. 2 and 3. FIG. 1 illustrates the waveforms corresponding to half the repetition period, Tf/2, and the waveforms corresponding to another half of the of repetition period succeeding this are omitted because they are obtained by interchanging Vx and Vy. Vx−Vy is a difference between the X electrode voltage and the Y electrode voltage, that is a voltage between the X and Y electrodes. Although not shown in FIG. 1, the address electrode is supplied with a fixed voltage of about Vs/2. The light emission is represented by a waveform (designated as LIR) of Xe 828 nm light emission (which is light emission of 828 nm in wavelength from excited Xe atoms) which gives a measure of ultraviolet ray generation.

FIG. 2 is a block diagram illustrating a basic configuration of a plasma display device of Embodiment 1 in accordance with the present invention.

Figure 14:
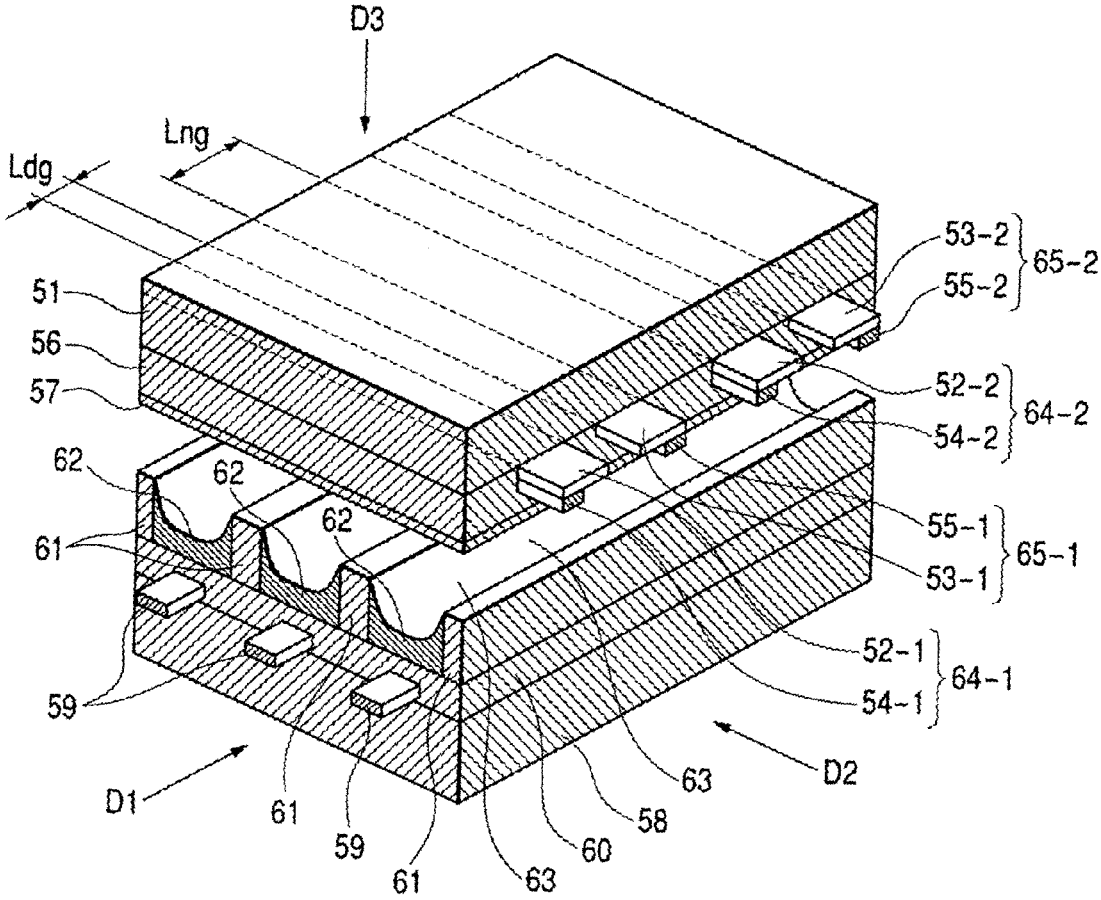
FIG. 14 is an exploded perspective view illustrating an example of a conventional ac surface-discharge type PDP of a three-electrode structure.
Figure 15:
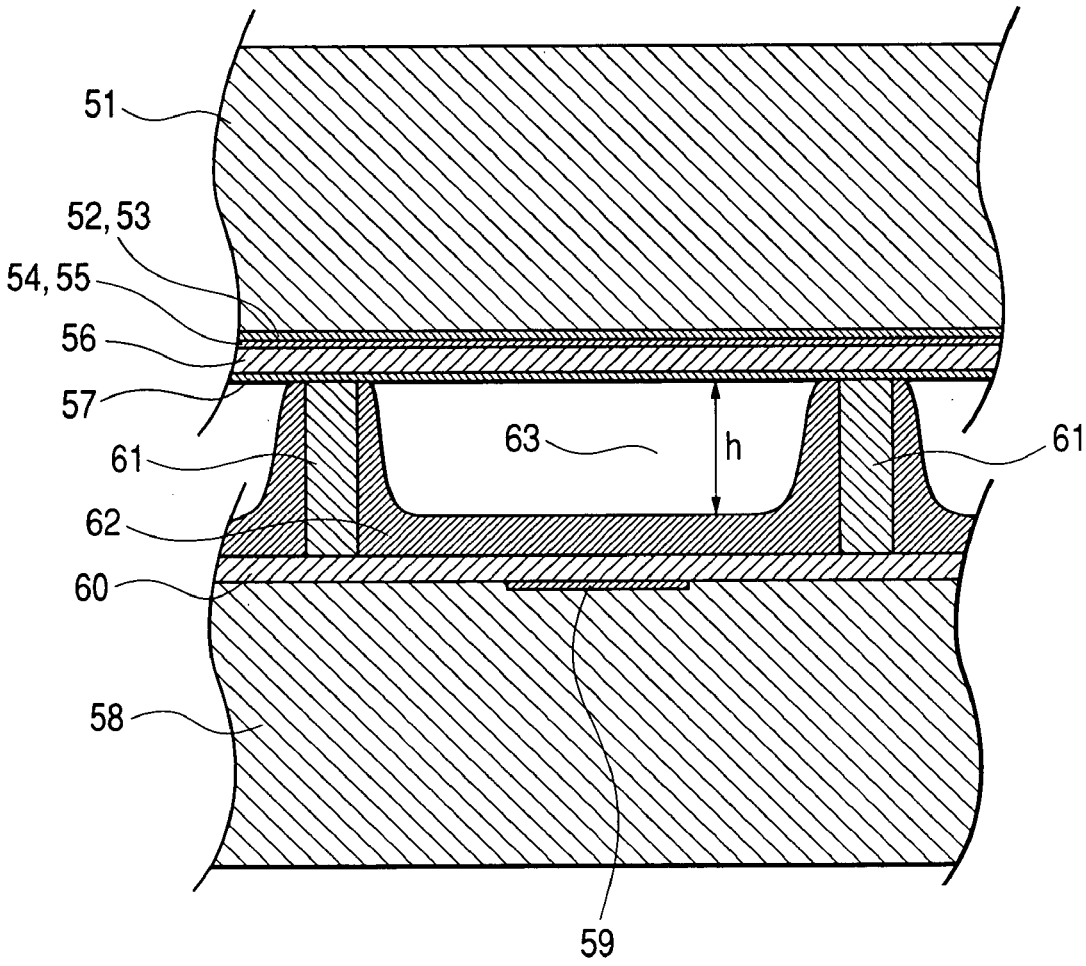
FIG. 15 is a cross-sectional view of the plasma display panel of FIG. 14 viewed in the direction of the arrow D1 in FIG. 14.
Figure 16:
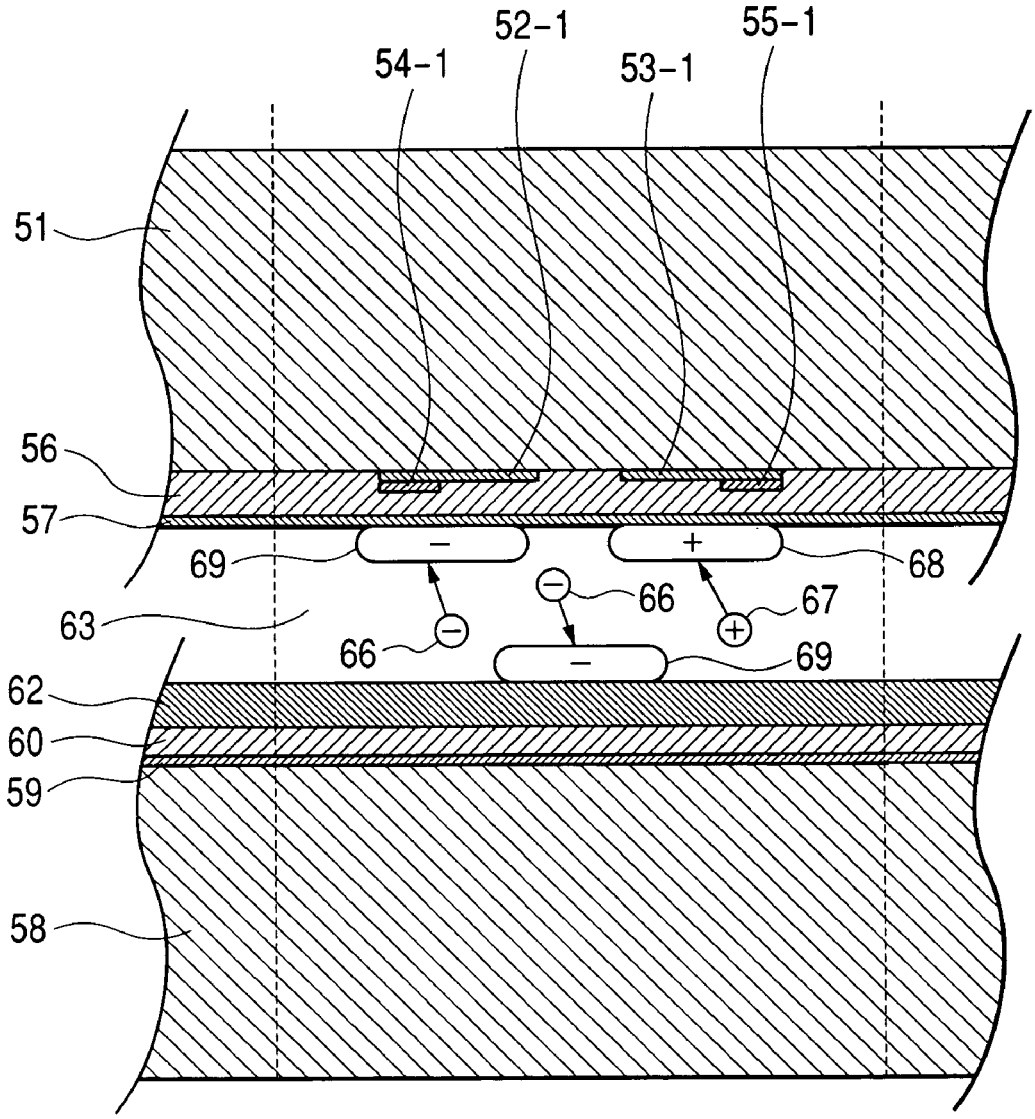
FIG. 16 is a cross-sectional view of the plasma display panel of FIG. 14 viewed in the direction of the arrow D2 in FIG. 14.
Figure 17:
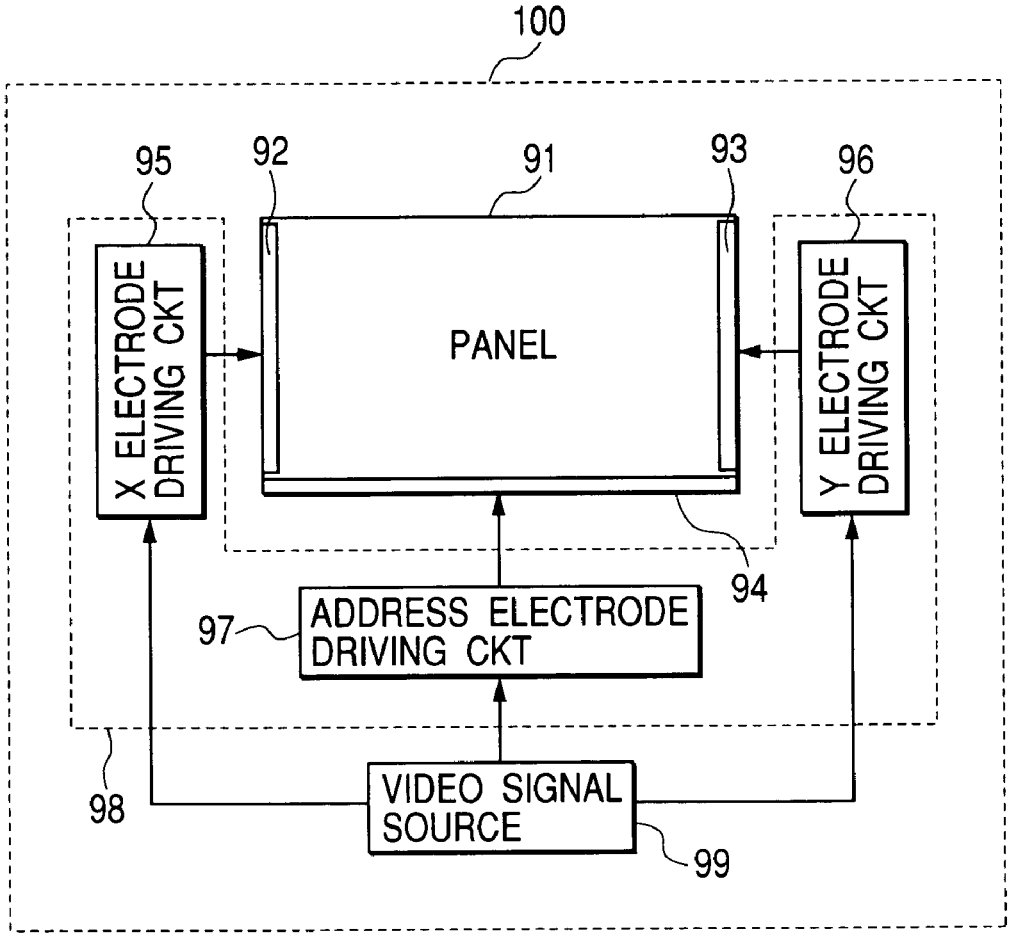
FIG. 17 is a block diagram illustrating a basic configuration of a conventional plasma display device.

First, the basic configuration of the plasma display device 100*a* of this embodiment will be explained. As shown in FIG. 2, this Embodiment 1 comprises: a panel 91 having discharge cells of a structure similar to that of the prior art explained in connection with FIG. 14; an X electrode terminal portion 92, a Y electrode terminal portion 93 and an address electrode terminal portion 94 which serve as connecting portions between the electrodes within the panel 91 and external circuits, respectively; a driving circuit 98*a* composed of an X electrode driving circuit 95*a*, a Y electrode driving circuit 96*a* and an address electrode driving circuit 97*a* for supplying voltages to and driving the X, Y and address electrodes, respectively; a load factor calculator 3 for calculating a load factor of a picture of one frame based upon video signals from a video signal source 99; a load factor compensator 4 for selecting sustain pulse voltage waveforms, the number of sustain pulses, and distributing the sustain pulses to respective sub-fields according to the calculated load factor; and the video signal source 99 for supplying the video signals for display to the driving circuit 98*a* via the load factor calculator 3 and the load factor compensator 4.

EXAMPLE 1 OF EMBODIMENT 1 OF THE PRESENT INVENTION

FIG. 3 is a diagram of the X electrode driving circuit 95*a* of the plasma display device 100*a* of Example 1 of Embodiment 1 in accordance with the present invention, for explaining its operation during the sustain period. For simplicity, the same symbols (Sxru-Sxd) as utilized to denote the input signals to the switches in FIG. 1 designate the corresponding switches (formed by transistors in practice) in FIG. 3. The same shall apply hereinafter.

The X electrode driving circuit 95*a* comprises a power recover circuit 101 composed of switches Sxru, Sxrd, diodes Dxru, Dxrd, a power recovery capacitor Cxr, a power recovery coil Lxr, and a grounding terminal GND; switches Sxu, Sxd, Sxup; power supplies for supplying voltages Vs, Vp; and a grounding terminal GND. Although the Y electrode driving circuit 96*a* is not shown in FIG. 3, it is similar to the X electrode driving circuit 95*a*, and its circuit components are denoted by symbols with the suffix y in place of the suffix x. That is to say, the Y electrode driving circuit 96*a* comprises a power recover circuit 101 composed of switches Syru, Syrd, diodes Dyru, Dyrd, a power recovery capacitor Cyr, a power recovery coil Lyr, and a grounding terminal GND; switches Syu, Syd, Syup; power supplies for supplying voltages Vs, Vp; and a grounding terminal GND. FIG. 3 indicates a panel capacitance Cp which is present between the X electrode driving circuit 95*a* and the Y electrode driving circuit, and which corresponds to the total capacitance between the sustain electrodes of the panel 91. The X electrode driving circuit 95*a* in FIG. 3 is provided with the power recovery circuit 101, which may be omitted from the X electrode driving circuit.

A method of driving the plasma display device of this embodiment will be explained by reference to FIGS. 18A–18C, FIGS. 1–3. The basics of the driving method during one TV field period of the PDP is similar to that explained in connection with FIGS. 18A–18C. That is to say, as shown in portion II of FIG. 18A, each of the sub-fields comprises the reset period 79 for returning the discharge cells to their initial condition, the address period 80 for selecting ones of the discharge cells to be lighted, and the sustain period 81 for causing the selected discharge cells to emit light for display.

First, in FIG. 2, a load factor of a picture of one field is calculated by the load factor calculator 3 based upon video signals from the video signal source 99. This driving method serves a function of limiting the power consumption below a specified value at all times by controlling the number of the sustain pulses according to the calculated load factor, and this function is called APC (Automatic Power Control). That is to say, to maintain the power consumption constant when a picture of a load factor of h1 % (for example, 15%) not smaller than a specified value is displayed, the load factor compensator 4 reduces the number of sustain pulses with increasing load factor.

Further, two different kinds of sustain pulse waveforms are provided for a load factor greater than a given load factor h2 % and a load factor smaller than the given load factor h2 %, respectively. That is to say, a sustain pulse waveform wave 1 (waveform 1) is used for the load factor smaller than h2, and another sustain pulse waveform wave 2 (waveform 2) is used for the load factor greater than h2. In this case, at the boundary load factor between the two different sustain pulse waveforms, the two luminances produced by the discharges generated by the two waveforms are selected to be approximately equal to each other. Here, "approximately equal", means the degree of discontinuity between the two luminances which does not appear unnatural to the human eye.

Assume a case where, when the total power consumption by the total current including both the discharge current and the capacitive current is considered, the load factor dependency of the luminous efficacy is such that, at the load factor of hh, the luminous efficacy obtained by the wave 2 exceeds that obtained by the wave 1, with their relationship being reversed. That is to say, in this case, the luminous efficacies obtained by the wave 1 and the wave 2 become approximately equal to each other at the load factor hh. Therefore, if the boundary load factor h2 is selected to be the load factor hh, then the two luminances produced by the discharges generated by the two waveforms can be made approximately equal to each other at the boundary load factor.

Further, in a case where the boundary load factor h2 is selected to be a load factor greater than the load factor hh, for example, if the number of the sustain pulses at the load factor h2 is multiplied by a factor of $1/(\eta b2)$, where $\eta b2$ is the ratio of the luminous efficacy obtained by the wave 2 to that obtained by the wave 1, then the two luminances produced by the discharges generated by the two waveforms can be made approximately equal to each other at the boundary load factor.

As explained above, the load factor compensator 2 selects the kinds of sustain pulse waveforms and the number of sustain pulses, and distributes the sustain pulses to respective sub-fields according to the calculated load factor, and thereby drives the driving circuit 98*a*.

As described above, the relationship between the number of sustain pulses and luminance for a case having at least two kinds of sustain pulse voltage waveforms is provided in a table, and at the boundary load factor at which a changeover is performed from one to another of the at least two kinds of sustain pulse voltage waveforms, the number of sustain pulses is selected such that two luminances produced by the discharges generated by the two waveforms can be made approximately equal to each other.

Figure 18B:
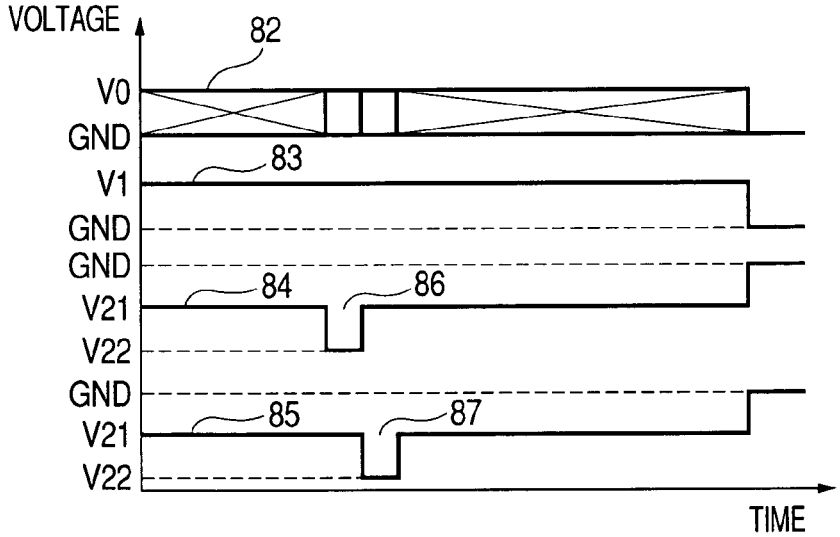
Figure 18C:
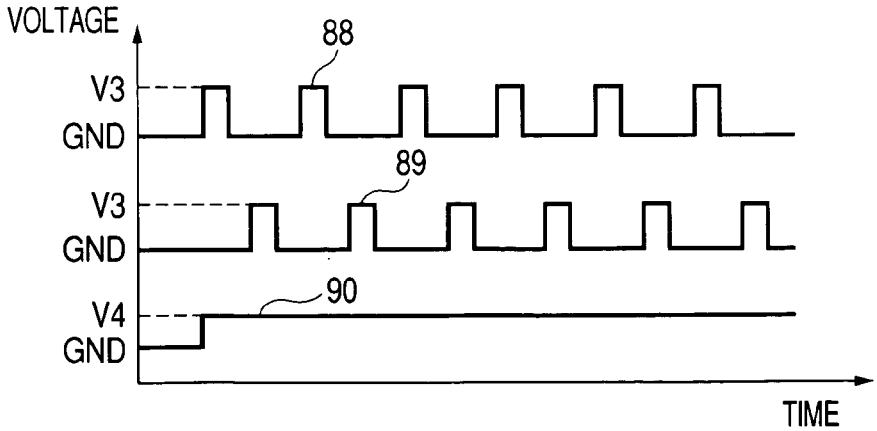

As shown in FIG. 18B, based upon the data from the load factor compensator during the address period 80, the address electrode driving circuit 97*a* outputs the A waveform 82, the X electrode driving circuits 95*a* outputs the X waveform 83, and the Y electrode driving circuit 96*a* outputs the Y waveforms 84, 85. As in the case of the prior art explained in connection with FIG. 18B, the address discharge is generated in the discharge cells desired to be lighted, and then the wall voltage Vw (V) is generated between the X and Y electrodes in the discharge cells desired to be lighted. In this way, the discharge cells to be lighted during the sustain period are selected. During the sustain period, by applying between the X and Y electrodes 64, 65 a voltage of such a magnitude as to generate a discharge only when this wall voltage is present between the X and Y electrodes, only the desired discharge cells produce discharge and generate light.

As shown in FIG. 1, each of the voltage waveforms Vx, Vy of the X, Y sustain pulses is a two-step waveform having applied at a time of its rising an intermediate voltage Vp lower than Vs and then having applied the voltage Vs. In this case, as shown in FIG. 1, the light emission waveform LIR is a plural-peak light emission waveform having a pre-discharge 2 prior to a main discharge 1. The reasons of this phenomenon and the resultant increase in luminous efficacy will be explained as follows:

The intermediate voltage Vp is applied during a period T2, therefore a discharge start voltage is exceeded by the wall voltage accumulated between the X and Y electrodes by a preceding discharge within the sustain period, superimposed with the intermediate voltage Vp, and as a result the pre-discharge 2 occurs. Here, the applied voltage Vp is low, and the discharge-space voltage between the X and Y electrodes is also low, and consequently, the generated discharge light emission is that at a low electron temperature, and the ultraviolet ray production efficiency is improved.

This pre-discharge decreases the wall voltage, and therefore the discharge weakens once. Next, the voltage Vs is applied during a period when the priming effect due to the pre-discharge remains, the discharge start voltage is exceeded again, and therefore the main discharge occurs. Here, in this main discharge also, the discharge-space voltage is lowered by the decrease in the wall voltage between the X and Y electrodes caused by the pre-discharge, and consequently, the generated discharge light emission is that at a low electron temperature, and the ultraviolet ray production efficiency is improved. In this way, both the pre-discharge and the main discharge are those at low electron temperatures, and consequently, the ultraviolet ray production efficiency is improved, resulting in increasing of the luminous efficacy.

In the above example, the load factor calculator 3 calculates the load factor of a picture of one field period based upon the video signals from the video signal source 99 in FIG. 2, but by setting the load factor calculator 3 such that it calculates a load factor of a picture of one sub-field period based upon the video signals from the video signal source 99, the above-explained driving method can be carried out in a similar way for each of the sub-fields.

The following will explain the operation during half the repetition period, Tf/2, of the X and Y electrode driving circuits for generating the X and Y sustain pulse waveforms, respectively, by reference to FIGS. 1 and 3.

The sustain pulse waveforms Vx and Vy in FIG. 1 are the voltage waveform at a node Nx1 of FIG. 3 and that at a corresponding node Ny1 of the Y electrode driving circuit (not shown). During half the repetition period indicated in FIG. 1, all the switches (not shown) other than the switch Syd (not shown) of the Y electrode driving circuit 96*a* are turned OFF, and are connected to ground, and therefore Vy is kept at 0 V. The operation of the X electrode driving circuit 95*a* is as follows:

During the period T1, the switch Sxru is ON, and all the switches other than the switch Sxru are OFF. Therefore, the power recovery capacitor Cxr is connected to the power recovery coil Lxr via the switch Sxru and the diode Dxru, and the voltage at the node Nx1 rises curvedly from ground potential due to the LC resonance of the power recovery coil Lxr and the panel capacitance Cp. At this time, the charge stored in the power recovery capacitor Cxr is released into the panel capacitance Cp via the switch Sxru, the diode Dxru and the power recovery coil Lxr.

During the period T2, the switch Sxup is turned ON, and all the switches other than the switch Sxup are turned OFF. Therefore, the node Nx1 is connected to the power supply of the voltage Vp via the switch Sxup, and is kept at the intermediate voltage Vp.

During the period T3, the switch Sxu is turned ON, and all the switches other than the switch Sxu are turned OFF. Therefore, the node Nx1 is connected to the power supply of the voltage Vs via the switch Sxu, and is raised to and kept at the voltage Vs.

During the period T4, the switch Sxrd is turned ON, and all the switches other than the switch Sxrd are turned OFF. Therefore, the power recovery capacitor Cxr is connected to the power recovery coil Lxr via the switch Sxrd and the diode Dxrd, and the voltage at the node N1 falls curvedly from the voltage Vs due to the LC resonance of the power recovery coil Lxr and the panel capacitance Cp. At this time, the power recovery capacitor Cxr is charged with the charge stored in the panel capacitance Cp via the power recovery coil Lxr, the diode Dxrd and the switch Sxrd.

During the period T5, the switch Sxd is turned ON, and all the switches other than the switch Sxd are turned OFF. Therefore, the node Nx1 is connected to ground potential GND via the switch Sxd, and falls to and is kept at 0 V.

The above-described operation provides the sustain pulse waveforms Vx and Vy shown in FIG. 1. The operation during the latter half of the repetition period corresponds to the above-described operation with X and x being replaced by Y and y, respectively, and therefore its explanation is omitted.

Figure 19:
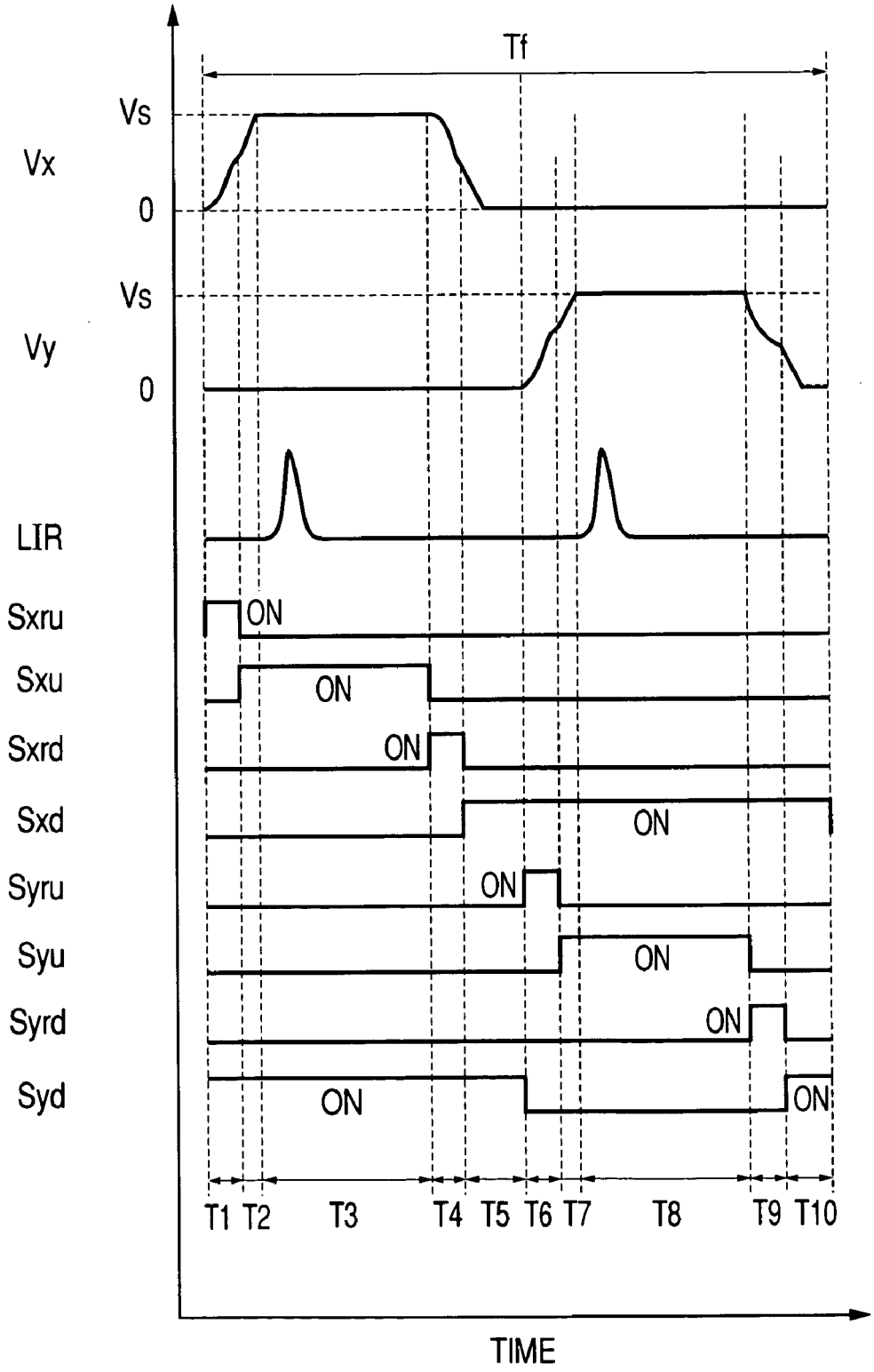
FIG. 19 is a time chart illustrating voltages, a light emission waveform, and input signals to switches during a sustain period in the conventional plasma display device.
Figure 20:
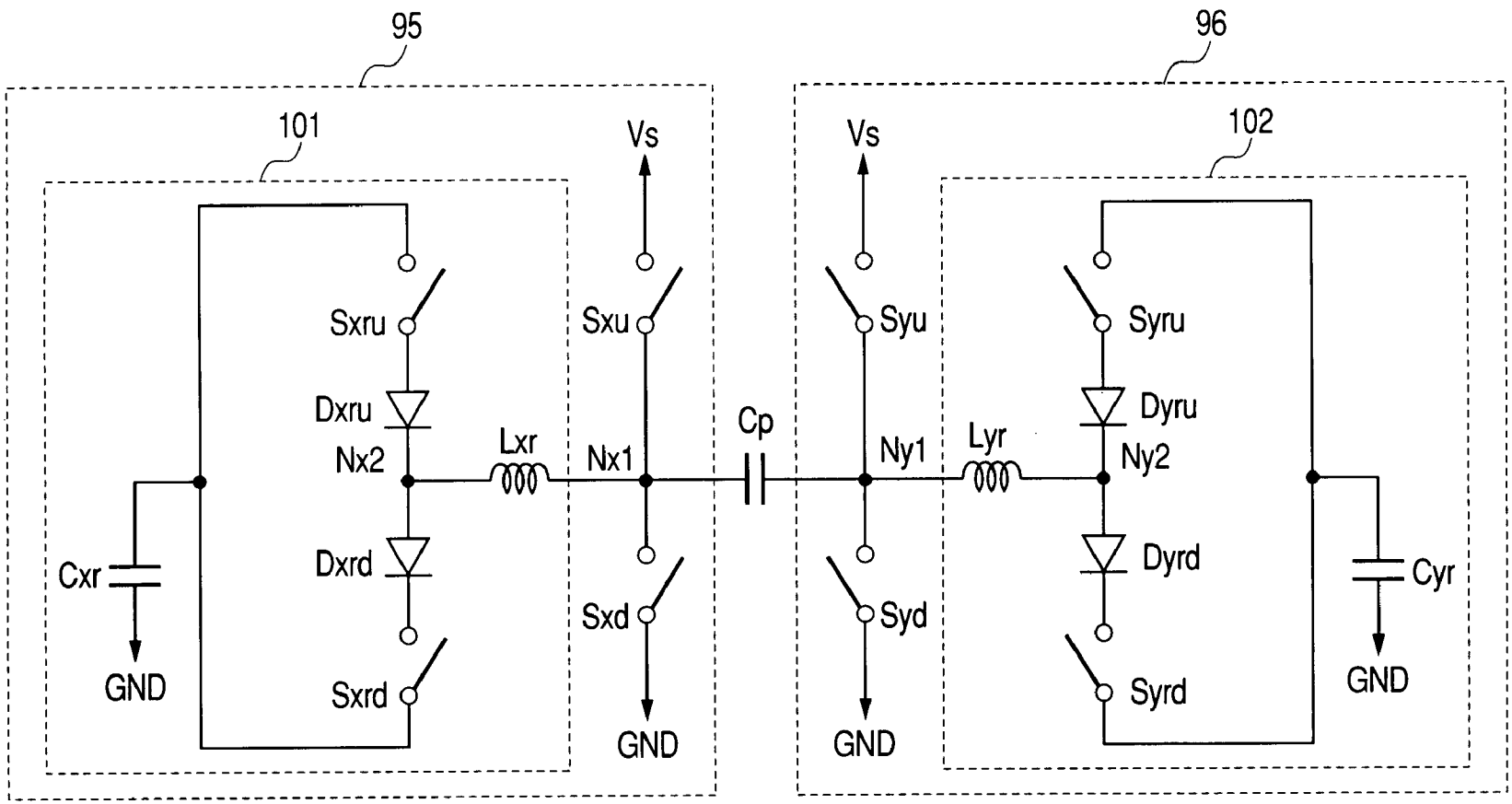
FIG. 20 is a diagram illustrating X and Y electrode driving circuits of the conventional plasma display device.

For comparison purposes, FIG. 19 illustrates sustain pulse waveforms Vx, Vy, a light emission waveform LIR, and input signals Sxru-Syd to the switches, during the sustain period 81 of the conventional plasma display device employing the power recovery circuit, and FIG. 20 illustrates a concrete example of the conventional X, Y electrode driving circuits 95, 96. This prior art differs from the present embodiment illustrated in FIG. 3, in that, as shown in FIG. 20, the switch Sxup and the power supply Vp are absent in the conventional X electrode driving circuit. Therefore, unlike the present embodiment explained in connection with FIG. 1, in the operation of the switches for generating the sustain pulses indicated in FIG. 19, the switch Sxup is not needed, and the period T2 (T2') associated with the intermediate voltage Vp is not present. As a result, unlike the present embodiment explained in connection with FIG. 1, as shown in FIG. 19, the pre-discharge is not generated, and therefore the light emission waveform LIR has a single peak. The operation of the Y electrode driving circuit is similar to that of the X electrode driving circuit, and its explanation is omitted.

As described above, the pre-discharge is generated by the application of the intermediate voltage Vp, and then the main discharge is generated by utilizing its priming effects. At this time, both the pre-discharge and the main discharge are generated at low discharge-space voltages, and hence at low electron temperatures, and consequently, the ultraviolet ray production efficiency is improved, resulting in improving of the luminous efficacy.

However, displaying of pictures having various load factors varying from 0% to 100% is necessary in TV or the like. Even when the load factor is low and the pre-discharge and the main discharge are being generated at a given low intermediate voltage Vp and a given sustain voltage Vs, the pre-discharge is weakened and the increase in luminous efficacy is sometimes reduced if the load factor increases. The reason might be that if the load factor increases, the currents flowing through resistors of the driving circuits and within the panel increase, therefore the voltage drop at the time of the pre-discharge increases, and the discharge-space voltage becomes too weak, and consequently, the pre-discharge is weakened.

Even in a case where stable two-step discharges occur repeatedly when the load factor is low, faulty displays such as flicker are sometimes produced if the load factor is increased. The reason might be that if the load factor increases, the currents flowing through resistors of the driving circuits and within the panel increase, therefore the voltage drop increases, and consequently, the discharge is weakened or ceased, resulting in unstable discharge.

To prevent the above problems and to drive the display panel stably regardless of variations in load factors of the discharge cells, there is provided a voltage drop compensating means for compensating for the increase in the voltage drop due to the increase in discharge current caused by the increased load factors. As the voltage drop compensating means, there is provided a wall charge accumulating means for accumulating many wall charges after start of discharge by sustain pulses or cessation of the discharge within the half repetition period Tf/2 indicated in FIG. 1.

The wall charges are accumulated rapidly during the discharge, but they are accumulated slowly near and after the cessation of the discharge since the remaining electric field weakens near and after the cessation of the discharge. Therefore, the longer the period T3 for applying the sustain voltage Vs, the more wall charges can be accumulated. This wall charge accumulating means lengthens the sustain pulse repetition period Tf (and hence the sustain-voltage Vs-applied period T3) indicated in FIG. 1. With this, since a larger number of charges are accumulated prior to the pre-discharge within the succeeding half-repetition-period, even if the voltage drop between the X and Y electrodes increases in the case of a large load factor, a sufficient discharge-space voltage is applied during the period T2 within the succeeding half-repetition-period, and consequently, an appropriate pre-discharge occurs. If the quantity of the wall charges consumed by this pre-discharge is approximately equal to that in the case of the small load factor, the quantity of the wall charge remaining after the pre-discharge is larger than that in the case where the sustain pulse period is not lengthened. Consequently, even when the load factor is large and the voltage drop is increased in the main discharge during the period T3, the increase in the wall discharge compensates for the decrease in the discharge-space voltage, and therefore the discharge is not weakened.

As explained above, by selecting the sustain pulse repetition period to be short for a small load factor, and selecting the sustain pulse repetition period to be long for a large load factor, stable discharges can be maintained for presentation of images of various load factors. Further, since the discharge is the two-step discharge type, the ultraviolet ray production efficiency is improved.

With the above-explained two-step discharge, at an image display load factor of 10%, the luminous efficacy is increased by 10% compared with the prior art, at image display load factors of 40% or more, the sustain pulse waveform of the doubled sustain repetition period is utilized, and at an image display load factor of 100%, the luminous efficacy is increased by 35% compared with the prior art. Since the improvement in luminous efficacy is greater at a high image display load factor than at a low image display load factor, streaking occurring in the image display is reduced from 20% to 5% or less, resulting in great improvement of the image quality. Here, streaking is a phenomenon in which an image produced at a large load factor appears darker than an image produced at a small load factor, when the same number of sustain pulses are used at both the large and small load factors, due to the voltage drop and others. It is represented by a deviation of the ratio of luminance at a 100% load factor to that at a 10% load factor from unity.

Further, a sustain pulse driving waveform is selected from among at least two different kinds of sustain pulse driving waveforms according to a corresponding load factor. In the above example, used as the sustain pulse waveform is the waveform for generating the two-step discharge as indicated in FIG. 1, but the conventional waveform as shown in FIG. 19 may be utilized instead. In a case where the two-step discharge waveform is used, the capacitive electric power sometimes increases compared with that in the case of the conventional waveform. In such a case, it is advantageous to use the conventional waveform for displaying an image at a low load factor because the luminous efficacy with respect to the total electric power including the discharge power and the capacitive power is improved.

Figure 21:
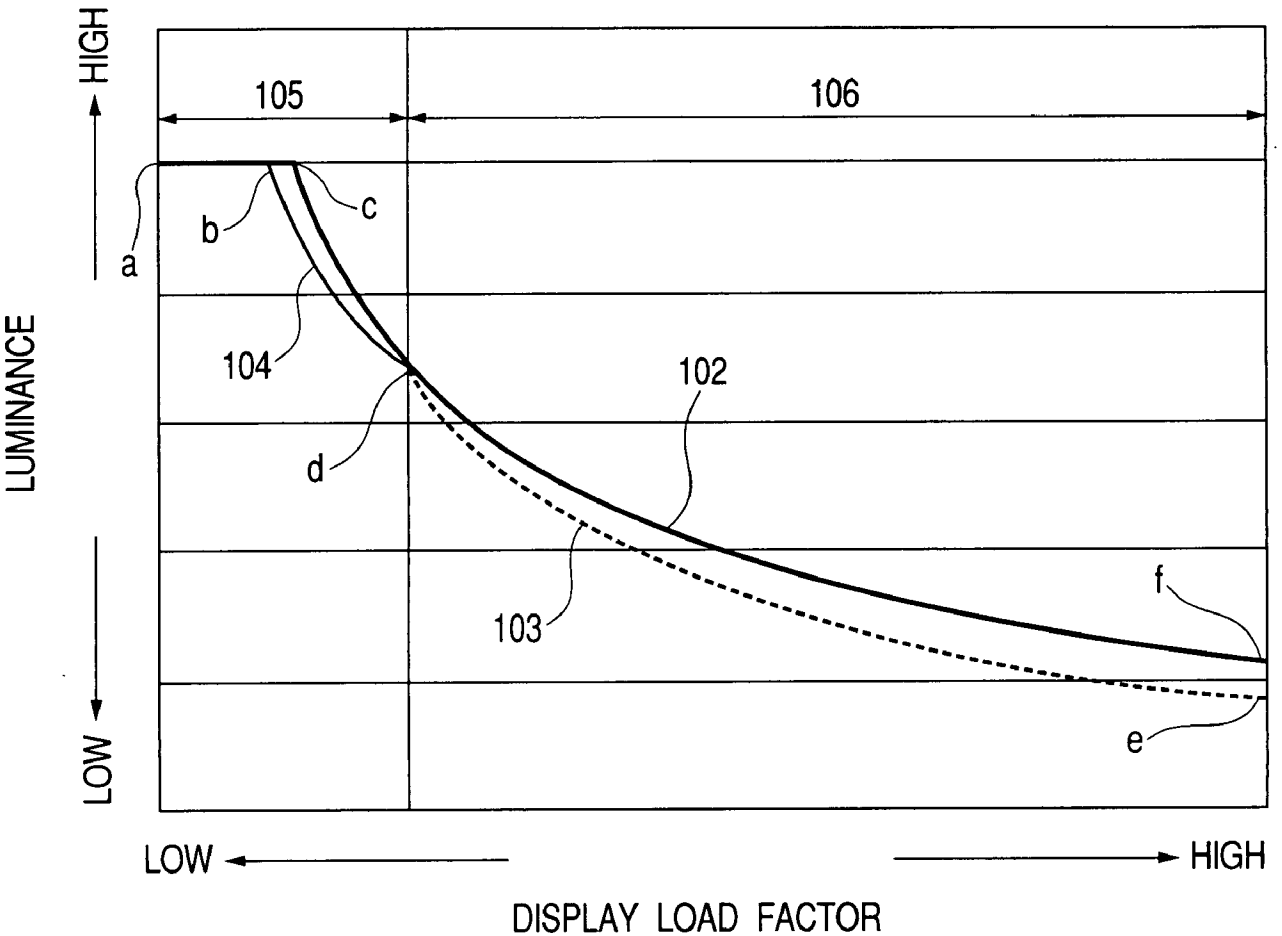
FIG. 21 is a graph illustrating variations in luminance versus load factors in displaying images when plural sustain-discharge waveforms are employed.

In FIG. 21, curve 102 (a-c-d-f) represents variations in luminance versus load factors in a case where a conventional driving method is employed at small load factors under conditions of electric powers below a specified value, curve 103 (a-c-d-e) represents a relationship between load factors and display luminance by controlling the number of discharges in the case of using the conventional waveform, and curve 104 (a-b-d-f) represents a relationship between load factors and display luminance by controlling the number of discharges in the case of using the two-step discharge waveform. In a region 106 of a large load factor, the two-step discharge waveform providing a high luminous efficacy is selected to increase display luminance, and in a region 105 of a small load factor, the conventional waveform of low capacitive power is selected. Further, in a case where there is a surplus of electric power at a small load factor, and the two-step discharge waveform produces high luminance, it is also effective to select the two-step discharge waveform for the region of the small load factor. That is to say, provision of a plurality of sustain discharge waveforms makes it possible to achieve the optimum luminance and electric power consumption.

Further, in the above example, a sustain pulse driving waveform is selected from among sustain pulse waveforms having two different kinds of sustain pulse repetition periods according to a corresponding load factor, and a sustain pulse driving waveform may be selected from among three or more kinds of sustain pulse waveforms according to a corresponding load factor.

As described above, in this example, the sustain pulse voltage applied between the sustain electrode pair includes at least an intermediate voltage Vp and a voltage Vs higher than the intermediate voltage Vs, the sustain discharge includes at least the pre-discharge and the main discharge succeeding the pre-discharge, the voltage drop compensating means is provided for compensating for an increase in voltage drop due to an increase in discharge current caused by an increase in a load factor of a display image of the PDP, and the above-mentioned intermediate voltage is provided by a power supply or grounding. Further, the wall charge accumulating means is provided for accumulating many wall charges after the start of discharge or cessation of the discharge within half the repetition period of the sustain pulse. The wall charge accumulating means applies a sustain pulse with its repetition period lengthened. This configuration provides a plasma display device capable of high-luminous-efficacy and stable driving at various image-display load factors.

EXAMPLE 2 OF EMBODIMENT 1 OF THE PRESENT INVENTION

In the above Example 1 of the Embodiment 1, the intermediate voltage Vp is provided by using a power supply. In the following, Example 2 of Embodiment 1 will be explained which employs an inductance Lp for production of the intermediate voltage Vp.

Figure 4:
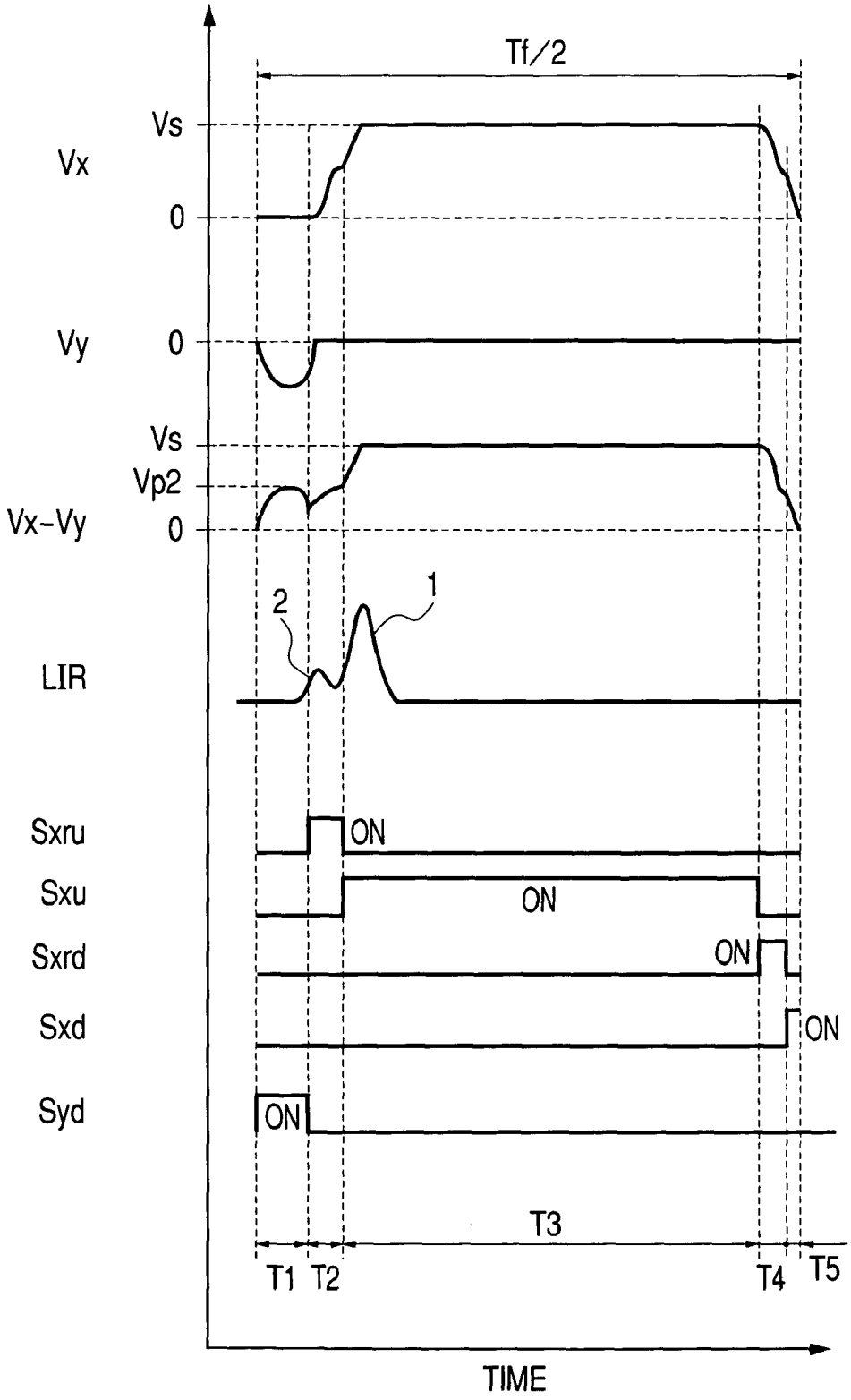
FIG. 4 is a time chart illustrating voltages, a light emission waveform, and input signals to switches during a sustain period in a plasma display device of Example 2 of Embodiment 1 in accordance with the present invention.
Figure 5:
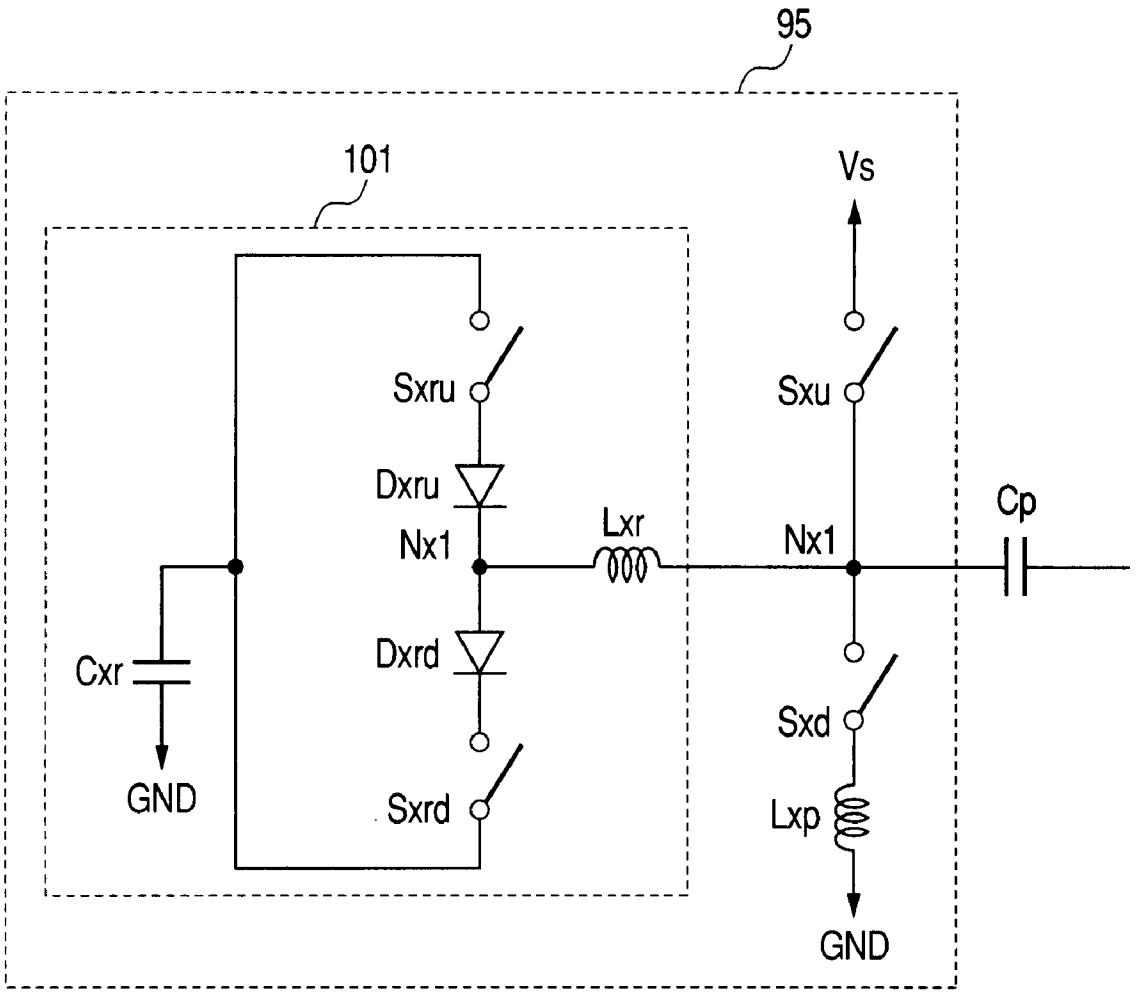
FIG. 5 is a diagram illustrating an X or Y electrode driving circuit of Example 2 of Embodiment 1 in accordance with the present invention.

FIG. 4 is a time chart illustrating sustain pulse waveforms Vx, Vy applied to all the X and Y electrodes, respectively, simultaneously, a light emission waveform LIR, and input signals Sxru-Sxrd to switches of an X electrode driving circuit 95*b* shown in FIG. 5 during the sustain period 81 (see FIG. 18A) in a plasma display device of Example 2 of Embodiment 1 in accordance with the present invention. The X electrode driving circuit 95*b* of FIG. 5 differs from the X electrode driving circuit 95*a* of FIG. 3, in that the power supply for the voltage VP of the switch Sxup of FIG. 3 are not present in FIG. 5, and in that an inductance element Lxp such as a coil is provided between the switch Sxd and the ground GND in FIG. 5. Although the Y electrode driving circuit is not shown in FIG. 5, it is similar to the X electrode driving circuit 95*b*, and its circuit components are denoted by symbols with the suffix y in place of the suffix x.

The following will explain the operation during half the repetition period, Tf/2, of the X and Y electrode driving circuits for generating the X and Y sustain pulse waveforms, respectively, by reference to FIG. 4. The sustain pulse waveforms Vx and Vy in FIG. 4 are the voltage waveform at a node Nx1 of FIG. 5 and that at a corresponding node Ny1 of the Y electrode driving circuit (not shown). In the following, only differences of this example from the explanation in connection with FIG. 1 will be described. During the period T1, the switch Syd is ON, the remainder of the switches is OFF, and therefore the LC resonance of the inductance Lyp and the panel capacitance Cp swings the voltage Vy to a negative voltage. As a result, the waveform Vx−Vy provides a sustain pulse waveform having an intermediate voltage as shown in FIG. 4. The driving by this sustain pulse waveform produces a two-step discharge including a pre-discharge 2 and a main discharge 1, and consequently, as in the case of the previous example, the ultraviolet ray production efficiency is improved, resulting in increasing of the luminous efficacy. The driving method in other respects are similar to that of Example 1 of Embodiment 1.

Further, although the inductance element is grounded in FIG. 5, it may be coupled to a fixed supply voltage. Further, wiring inductance of the circuit may be used as the above inductance element.

In the above examples 1 and 2 of Embodiment 1, the sustain pulse voltage waveform including the intermediate voltage Vp produces the two-step discharge, the voltage drop compensating means is provided for compensating for an increase in voltage drop due to an increase in discharge current which causes instability of discharge when a load factor of a display image is increased, and accumulates many wall charges after the start of discharge by one sustain pulse or after the discharge. The wall charge accumulating means lengthens the sustain pulse repetition period for accumulating many wall discharges.

EXAMPLE 3 OF EMBODIMENT 1 OF THE PRESENT INVENTION

In Example 3 of Embodiment 1 of the present invention, as a means for accumulating many wall charges when the load factor is increased, a voltage (hereinafter a post-discharge voltage) is applied around a time when a main discharge by one sustain pulse ceases such that an absolute value of a voltage difference Vs−Vy, a voltage between the sustain electrode pair, exceeds the voltage Vs.

Figure 6:
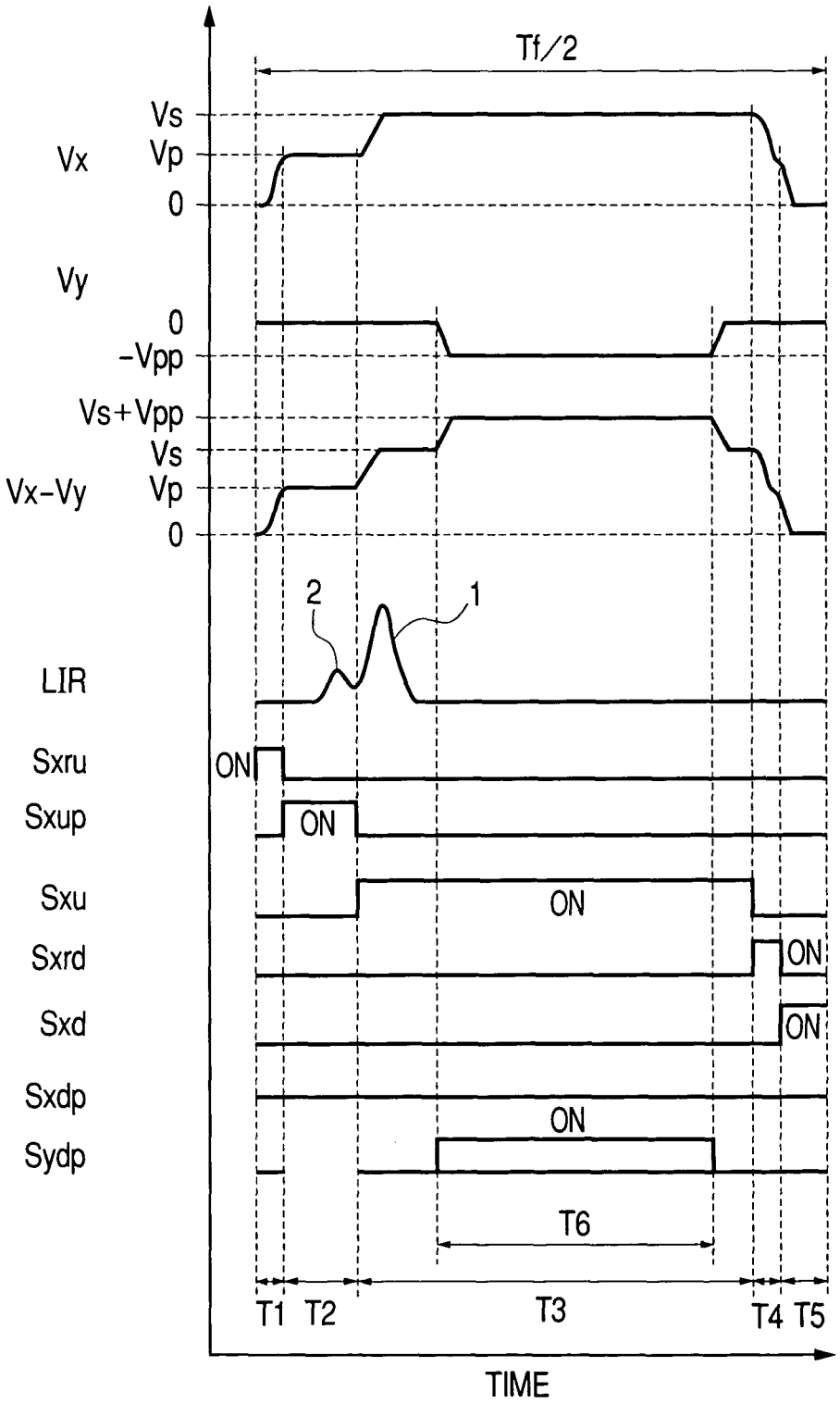
FIG. 6 is a time chart illustrating voltages, a light emission waveform, and input signals to switches during a sustain period in a plasma display device of Example 3 of Embodiment 1 in accordance with the present invention.

As shown in FIG. 6, basically, if a voltage (−Vpp) is superimposed upon the sustain pulse Vy of FIG. 1 for Example 1 of Embodiment 1 after cessation of the main discharge 1, for example, the voltage difference Vx−Vy becomes Vs+Vpp. The voltage Vpp can be selected to be 20 V, for example.

Usually, when the main discharge has ceased, the wall charges of the polarities opposite to those of the respective electrodes are accumulated, and the discharge-space voltage is low, but space charges such as ions, electrons, and metastable particles are present, and are converted slowly into a wall voltage during the remainder of the Vs-applied period, (T3+T4). However, in the case of a large image display load factor, if the period (T3+T4) is short, the conversion sometimes ceases before the wall charges are accumulated which are sufficient for producing the pre-discharge stably by a succeeding sustain pulse and then changing the pre-discharge into the main discharge, and consequently, repeating of the stable discharge cannot be realized. To eliminate this problem, the voltage Vs+Vpp is applied after the discharge to produce the discharge-space voltage, and thereby to convert the space charges into a wall voltage rapidly such that a pre-discharge is stably produced, and consequently, the main discharge is stably generated by using the priming effects by the pre-discharge.

Figure 7:
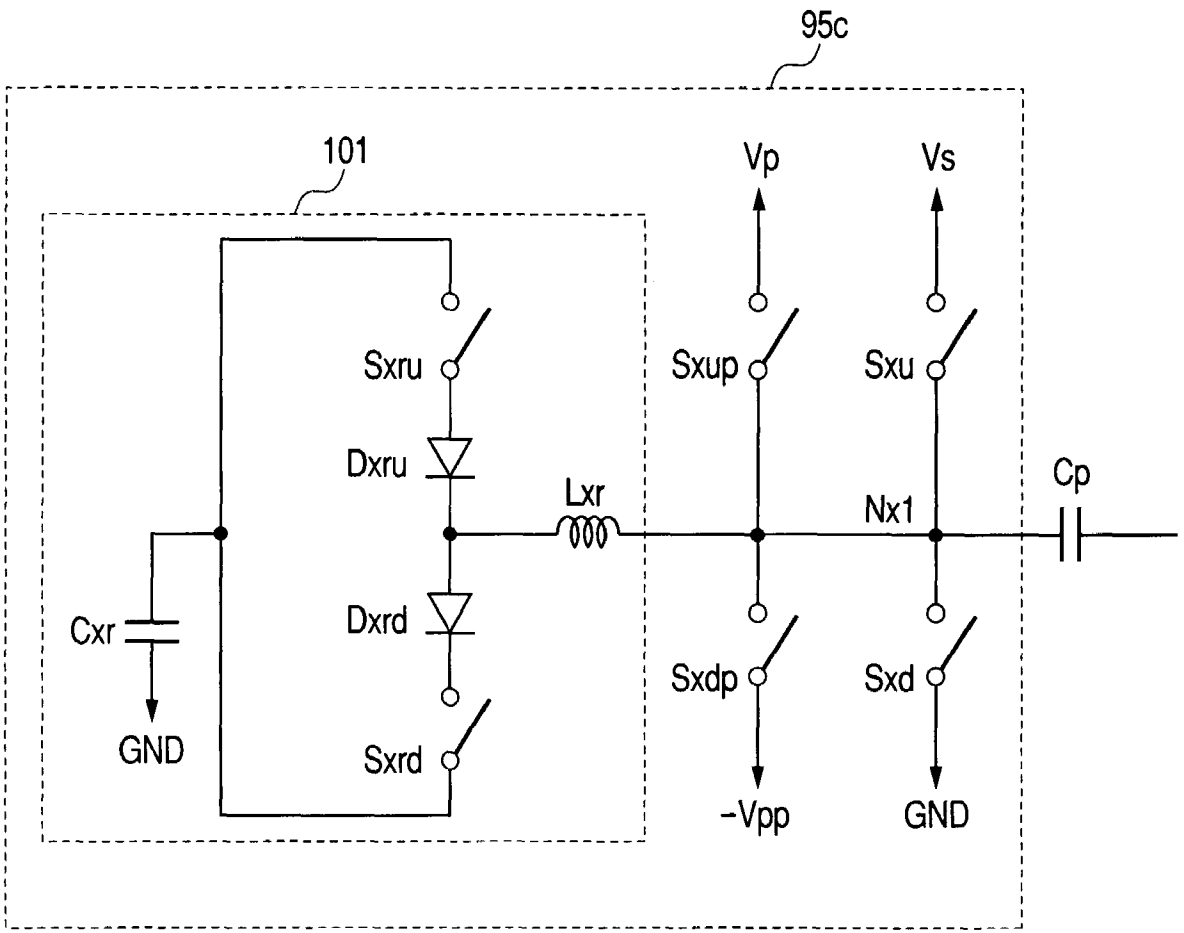
FIG. 7 is a diagram illustrating an X or Y electrode driving circuit of Example 3 of Embodiment 1 in accordance with the present invention.

FIG. 7 is a diagram illustrating an example of an X electrode driving circuit 95*c* related to the sustain period of a plasma display device 100*a* of Example 3 of Embodiment 1 in accordance with the present invention. The circuit of FIG. 7 is similar to that of FIG. 3 for Example 1 of Embodiment 1, except for the switch Sxdp (and the switch Sydp for the Y electrode driving circuit which is not shown) and a power supply of the voltage (−Vpp) connected to the switch Sxdp. The following will explain the operation during half the repetition period, Tf/2, of the X and Y electrode driving circuits for generating the X and Y sustain pulse waveforms, respectively, by reference to FIG. 6, but only differences from Example 1 of Embodiment 1 explained in connection with FIG. 1.

During the period T6 time when the added switch Sydp is ON, the node Ny1 is connected to the supply voltage (−Vpp) via the switch Sydp, and the voltage of the waveform Vy changes to (−Vpp). As a result, the voltage Vx−Vy is Vs+Vpp. During the periods other than the period T6, the switch Sydp is OFF. With this operation, the sustain pulse waveforms Vx, Vy, and Vx−Vy shown in FIG. 6 are obtained. The operation during the latter half of the repetition period corresponds to the above-described operation with X and x being replaced by Y and y, respectively, and therefore its explanation is omitted.

EXAMPLE 4 OF EMBODIMENT 1 OF THE PRESENT INVENTION

In Example 4 of Embodiment 1 of the present invention, for compensating for an increase in voltage drop caused by an increase in discharge current when the load factor increases, the voltage drop compensating means increases one or both of a voltage between the sustain electrodes and a pre-discharge start voltage between the electrodes. The following will explain only the differences between this Example and Example 1 of Embodiment 1. When the load factor is increased, both the voltages Vp and Vs shown in FIG. 1 are increased by ΔV=15 V, for example. With this, at the time of the pre-discharge, ΔV is added to the wall voltage produced after the main discharge by the preceding sustain pulse, and consequently, even if the voltage drop is increased due to an increase in discharge current when the load factor is increased, a sufficient voltage for generation of the pre-discharge is applied across the discharge space. Further, even if the wall voltage is decreased due to occurrence of the pre-discharge, and the voltage drop is produced by an increase in discharge current when the load factor is increased, a sufficient voltage for the main discharge is applied across the discharge space, and therefore repetition of the stable discharge is realized. Consequently, the luminous efficacy is improved by the two-step discharge, and at the same time, the repetition of stable discharge is realized for various image display load factors during the sustain period.

Embodiment 2

Figure 8:
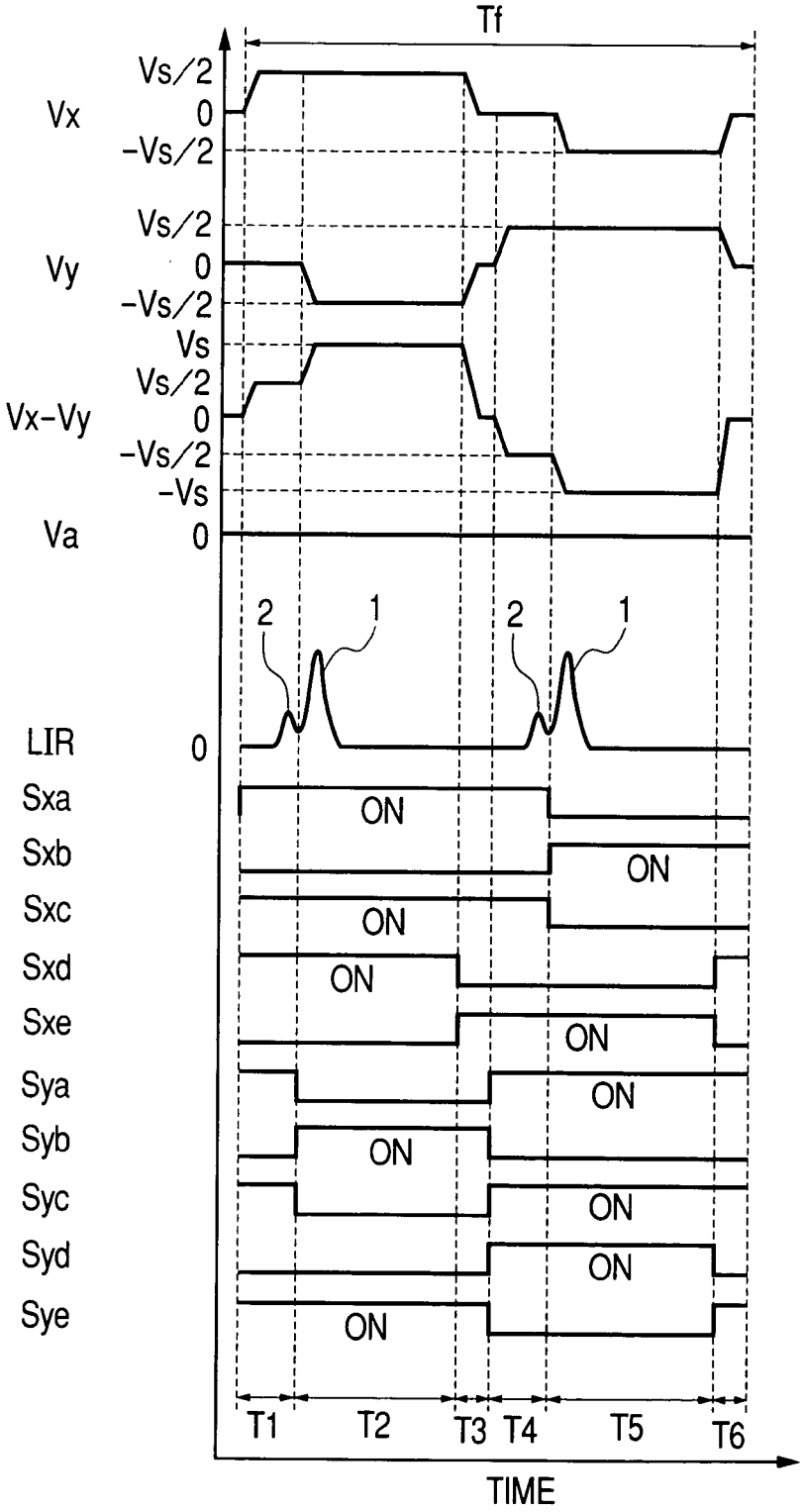
FIG. 8 is a time chart illustrating voltages, a light emission waveform, and input signals to switches during a sustain period in a plasma display device of Example 1 of Embodiment 2 in accordance with the present invention.
Figure 9:
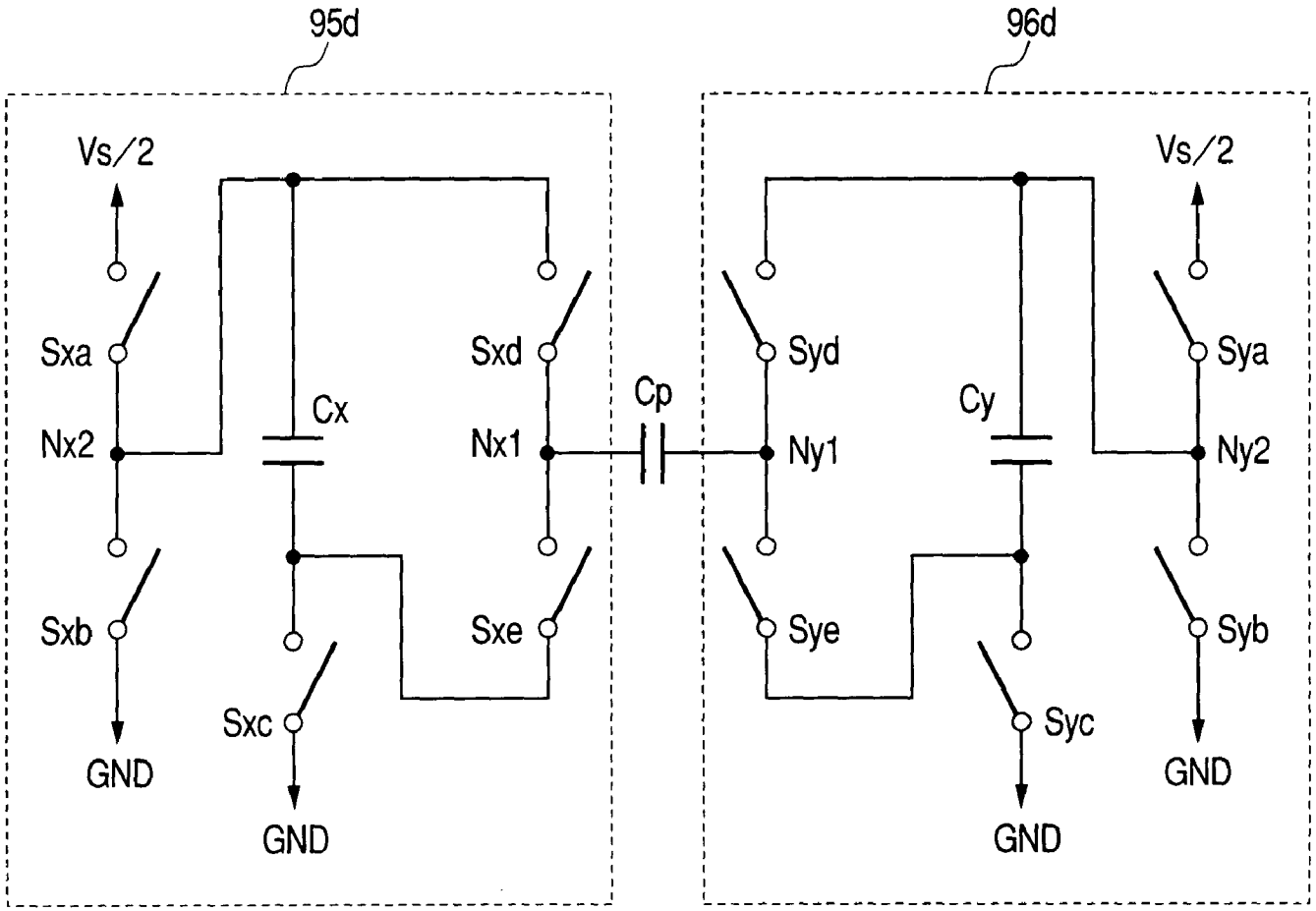
FIG. 9 is a diagram illustrating X and Y electrode driving circuits of Example 1 of Embodiment 2 in accordance with the present invention.

FIG. 8 is a time chart illustrating sustain pulse voltage waveforms Vx, Vy applied to all the X and Y electrodes, respectively, simultaneously, a light emission waveform LIR, and input signals Sxa-Sye to switches of the X and Y electrode driving circuits 95*d*, 96*d* of FIG. 9 during the sustain period 81 (see FIG. 18A) in a plasma display device of Example 1 of Embodiment 2 in accordance with the present invention. FIG. 8 illustrates the waveforms corresponding to one repetition period Tf.

FIG. 9 is a diagram illustrating an example of the X electrode driving circuit 95*d*, and the Y electrode driving circuit 96*d* related to the sustain period of the plasma display device of Example 1 of Embodiment 2 in accordance with the present invention. For simplicity, in FIG. 9, the power recovery circuit employed in Embodiment 1 is omitted. However, the power recovery circuit may be employed in FIG. 9, and the employment of the power recovery circuit does not interfere with the operation of this example. Conversely speaking, the power recovery circuit is not essential to realization of the present Embodiment 2. For simplicity, the indication of the power recovery circuit is also omitted in the subsequent examples of this Embodiment.

The circuit illustrated in FIG. 9 is similar to that for the TERES (Technology of Reciprocal Sustainer) driving disclosed in "A New Driving Technology for PDPs with Cost Effective Sustain Circuit," SID 01, pp. 1236–1239. A difference between the present Embodiment and the TERES driving lies in the timing of ON and OFF of the switches and resultant sustain pulse waveform Vx−Vy. In the sustain pulse waveform of the conventional TERES driving, there are almost no periods T1 and T4 when the waveform (Vx−Vy) has intermediate voltages Vs/2 and −Vs/2, respectively. The present Example 1 of Embodiment 2 differs from the conventional TERES driving, in that these periods for application of the intermediate voltages is intentionally provided for generating the pre-discharges.

The X electrode driving circuit 95*d* is composed of switches Sxa, Sxb, Sxc, Sxd and Sxe, a capacitor Cx, a grounding terminal GND, and a power supply of a voltage Vs/2. The Y electrode driving circuit 96*d* is composed of switches Sya, Syb, Syc, Syd and Sye, a capacitor Cy, a grounding terminal GND, and a power supply of a voltage Vs/2. Represented between the X and Y electrode driving circuits is a panel capacitance Cp equal to the total capacitance between the sustain electrodes of the panel 91.

The following will explain the operation during one repetition period Tf of the X and Y electrode driving circuits 95*d*, 96*d* for generating the X and Y sustain pulse waveforms, respectively, by reference to FIGS. 8 and 9. The sustain pulse waveforms Vx and Vy shown in FIG. 8 represent the voltage waveforms at the nodes Nx1 and Ny1, respectively, in FIG. 9.

The operation of the X electrode driving circuit 95*d* will be explained.

During the periods T1 and T2, the switches Sxa, Sxc and Sxd are ON, and the switches Sxb and Sxe are OFF. Therefore the power supply of the voltage Vs/2 is connected to the node Nx2 via the switch Sxa, and is connected to the node Nx1 via the switch Sxd, and as a result, the X electrode is supplied with and retained at the voltage Vs/2. Simultaneously with this, since one terminal of the capacitor Cx is connected to the ground GND via the switch Sxc, and the other terminal of the capacitor Cx is connected to the node Nx2 at the voltage Vs/2, the capacitor Cx is charged such that a voltage between its terminals equals Vs/2.

During the periods T3 and T4, the switches Sxa and Sxc remain ON, and the switch Sxb remains OFF, the switch Sxd is turned OFF, and the switch Sxe is turned ON. Therefore the node Nx1 is connected to the ground GND via the switch Sxe, the X electrode changes from the voltage Vs/2 to 0 V, and is retained at 0 V.

During the period T5, the switch Sxd remains OFF, the switch Sxe remains ON, the switches Sxa and Sxc are turned OFF, and the switch Sxb is turned ON. Therefore the node Nx2 is connected to the ground GND via the switch Sxb, and since the switch Sxc is turned OFF, the voltage across the capacitor Cx is retained at Vs/2. Since the node Nx1 is connected to the capacitor Cx and the node Nx2 via the switch Sxe, the node Nx1 changes to and is retained at (−Vs/2). That is to say, since the capacitor Cx functions as a power supply of the voltage (−Vs/2), the X electrode changes from 0 V to (−Vs/2), and is retained at (−Vs/2).

During the period T6, the switches Sxa and Sxc remain OFF, the switch Sxb remains ON, the switch Sxd is turned ON, and the switch Sxe is turned OFF. Therefore, since the node Nx1 is connected to the ground GND via the switch Sxd, the node Nx2, the switch Sxb, the potential of the X electrode changes from (−Vs/2) to 0 V, and is retained at 0 V.

The operation of the Y electrode driving circuit 96*d* is the same as the operation of the X electrode driving circuit 95*d* displaced by half the repetition period, that is, the operation of the X electrode driving circuit with the periods from T1 to T3 and the periods from T4 to T6 being interchanged, and its explanation is omitted.

With the above-explained operation, the sustain pulse waveforms Vx, Vy shown in FIG. 8, and as a result the waveform Vx−Vy as shown in FIG. 8 is obtained. This waveform differs from that of the conventional TERES driving, in that the waveform Vx−Vy of this example is provided with the periods T1 and T4 for application of the intermediate voltages Vs/2 and (−Vs/2), respectively.

The following will explain the reason why the luminous efficacy is increased by driving with the sustain pulse waveforms of the present Example 1 of Embodiment 2.

As shown in FIG. 8, the waveform Vx−Vy is a two-step waveform in which the intermediate voltage Vs/2 lower than Vs is applied during the period T1, and thereafter the voltage Vs is applied.

In a case where the voltage Vs is selected to be an appropriate value, 180 V, for example, and hence Vs/2 is 90 V, the pre-discharge 2 is generated during the period T1, and the light emission waveform LIR has a peak 2 corresponding to the pre-discharge prior to a peak 1 corresponding to the main discharge, as shown in FIG. 8. During the period T2, since the intermediate voltage Vp is applied, the intermediate voltage Vp superimposed with the wall voltage accumulated between the X and Y electrodes by the previous discharge exceeds the discharge start voltage and therefore the pre-discharge 2 is generated. Here, the applied voltage Vp is low, the discharge-space voltage between the X and Y electrodes is also low, light emission is generated by discharge at a low electron temperature, and therefore the ultraviolet ray production efficiency is increased. The wall voltage is reduced by the above-mentioned pre-discharge, and thereby the discharge is weakened once. Thereafter the voltage Vs is applied while the priming effects by the pre-discharge are present, and therefore the discharge start voltage is exceeded and the main discharge is generated. Here, in this main discharge also, since the discharge-space voltage is lowered by the reduction in the wall voltage between the X and Y electrodes due to the pre-discharge, light emission is generated by discharge at a low electron temperature, and therefore the ultraviolet ray production efficiency is increased. In this way, both the pre-discharge and the main discharge are generated at low electron temperatures, and consequently, the ultraviolet ray production efficiency is improved, and thereby the luminous efficacy is improved.

Stable driving for various load factors can be achieved by taking measures according to various load factors in similar ways to those explained in connection with Embodiment 1, and therefore its explanation is omitted. To give an example, in an image display having a load factor above a specified value, by lengthening the repetition period Tf of the sustain pulse shown in FIG. 8 and thereby collecting many wall charges, a discharge by a succeeding sustain pulse can be stabilized. The X and Y electrode driving circuits themselves for the conventional TERES driving can be employed only by changing switching timing of the switches, e.g. rewriting a waveform ROM (Read-Only Memory) for this Embodiment. Therefore, this Example has an advantage that increasing of the luminous efficacy can be achieved without any additional cost in a case where the TERES driving circuit is employed.

EXAMPLE 2 OF EMBODIMENT 2 OF THE PRESENT INVENTION

Figure 10:
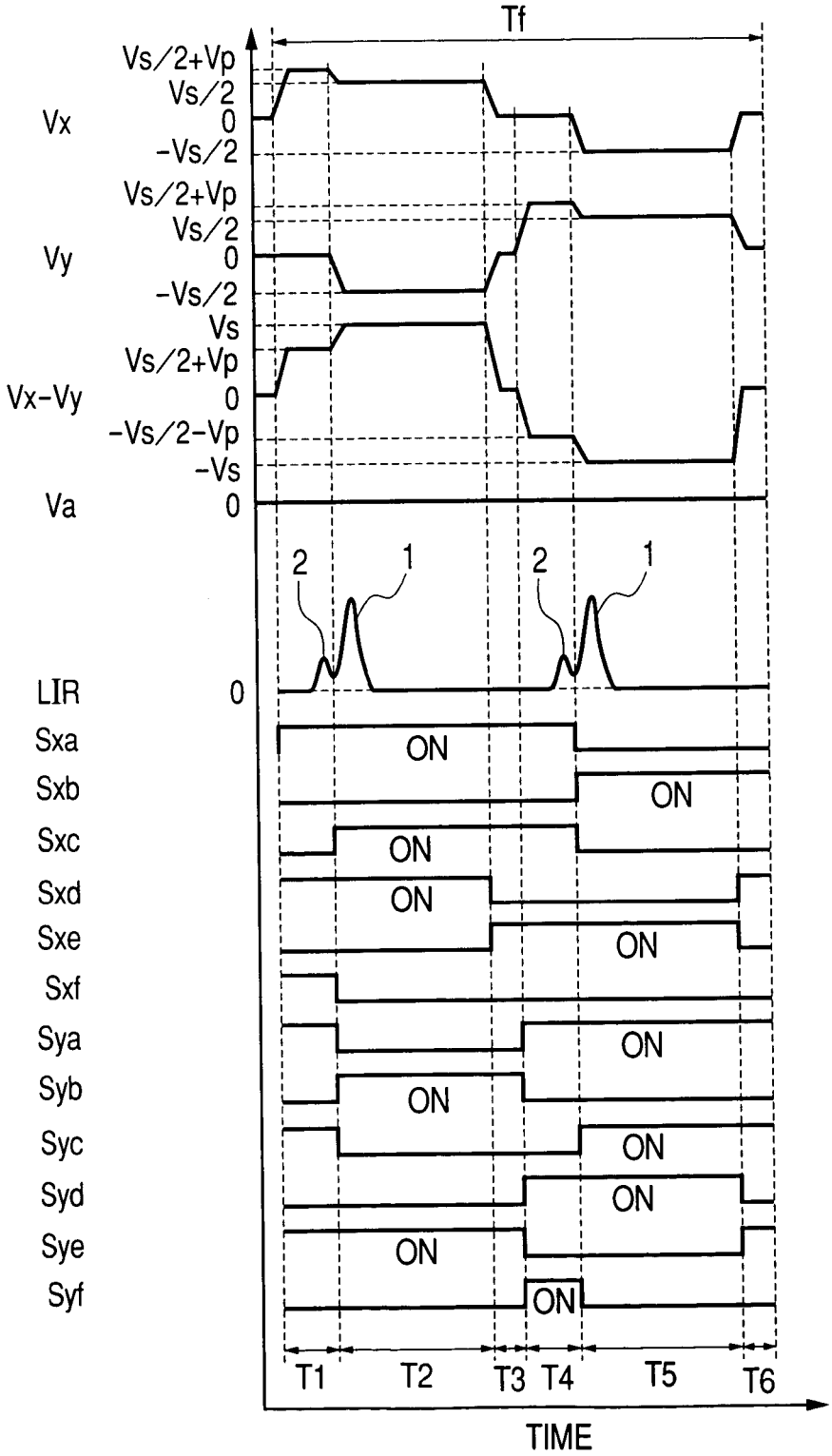
FIG. 10 is a time chart illustrating voltages, a light emission waveform, and input signals to switches during a sustain period in a plasma display device of Example 2 of Embodiment 2 in accordance with the present invention.
Figure 11:
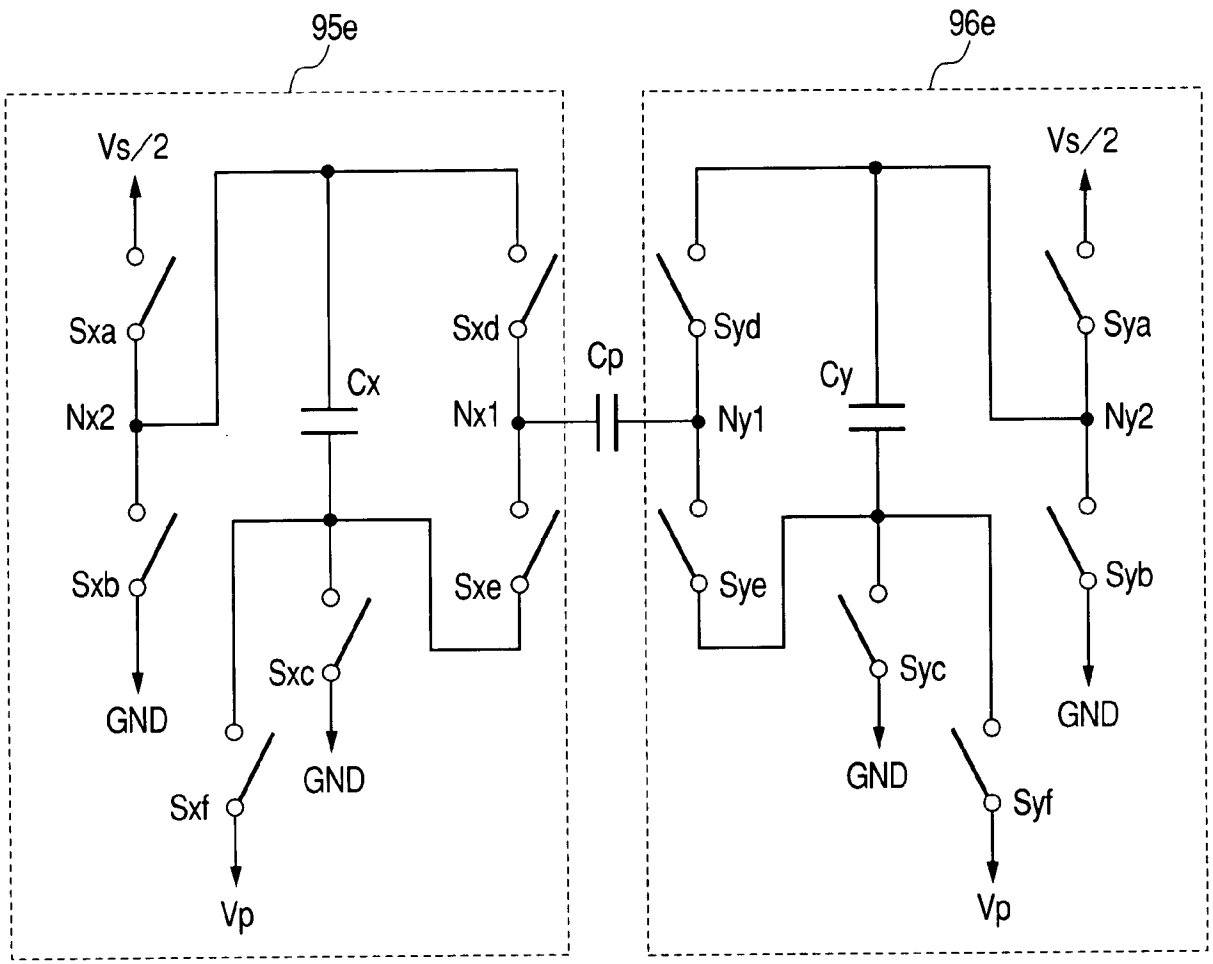
FIG. 11 is a diagram illustrating X and Y electrode driving circuits of Example 2 of Embodiment 2 in accordance with the present invention.

FIG. 10 is a time chart illustrating sustain pulse voltage waveforms Vx, Vy applied to all the X and Y electrodes, respectively, simultaneously, a light emission waveform LIR, and input signals Sxa-Syf to switches of the X and Y electrode driving circuits 95*e*, 96*e* of FIG. 11 during the sustain period 81 (see FIG. 18A) in a plasma display device of Example 2 of Embodiment 2 in accordance with the present invention. FIG. 10 illustrates the waveforms corresponding to one repetition period Tf.

FIG. 11 is a diagram illustrating an example of the X electrode driving circuit 95*e*, and the Y electrode driving circuit 96*e*related to the sustain period of the plasma display device of Example 2 of Embodiment 2 in accordance with the present invention. The X and Y electrode driving circuits 95*e*, 96*e*differ from the X and Y electrode driving circuits 95*d*, 96*d* of Example 1 of Embodiment 2, in that a switch Sxf, a power supply of the voltage Vp, a switch Syf, and a power supply of the voltage Vp are added. The operation during one repetition period Tf of the X and Y electrode driving circuits 95*e*, 96*e*for generating the X and Y sustain pulse waveforms, respectively, differs from the X and Y electrode driving circuits 95*d*, 96*d* of Example 1 of Embodiment 2, in that, in FIG. 10, during the period T1, the switch Sxf is turned ON while the switch Sxc remains OFF, and during the period T4, the switch Syf is turned ON while the switch Syc remains OFF. With this configuration, during the period T1, instead of Vs, the voltage superimposed with Vp, i.e. Vs+Vp, is applied to the node N1, that is, the X electrode. Therefore the intermediate voltage can be selected to be a voltage optimum for the pre-discharge regardless of the voltage Vs. The principle of increasing of the luminous efficacy and a method of stabilizing discharge at a large load factor are the same as in the case of Example 1 of Embodiment 2, and therefore their explanation is omitted.

EXAMPLE 3 OF EMBODIMENT 2 OF THE PRESENT INVENTION

Figure 12:
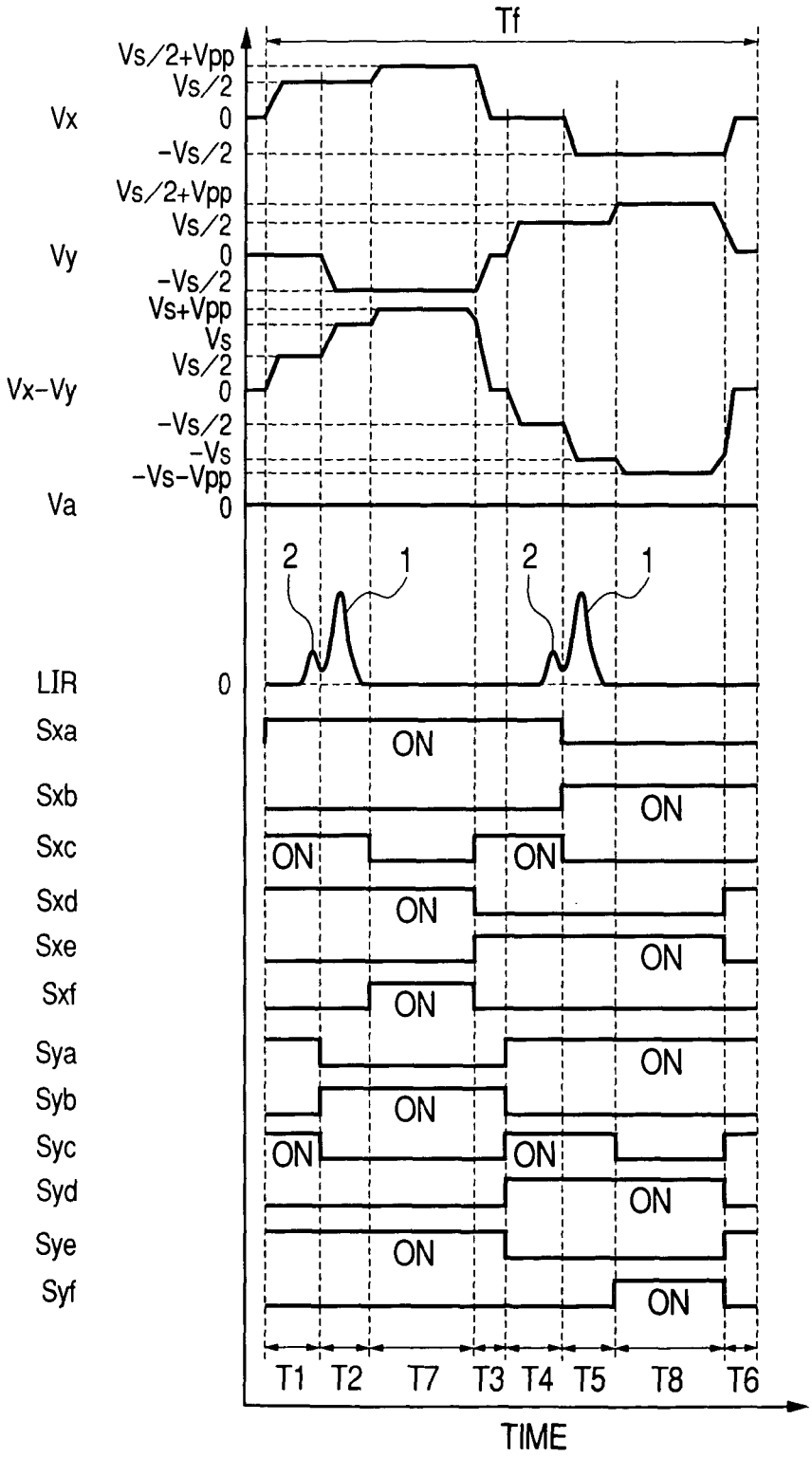
FIG. 12 is a time chart illustrating voltages, a light emission waveform, and input signals to switches during a sustain period in a plasma display device of Example 3 of Embodiment 2 in accordance with the present invention.

FIG. 12 is a time chart illustrating sustain pulse voltage waveforms Vx, Vy applied to all the X and Y electrodes, respectively, simultaneously, a light emission waveform LIR, and input signals Sxa-Syf to switches of the X and Y electrode driving circuits 95*e*, 96*e* of FIG. 11 during the sustain period 81 (see FIG. 18A) in a plasma display device of Example 3 of Embodiment 2 in accordance with the present invention. The same driving circuits as in Example 2 of Embodiment 2 can be employed with the power supply Vp being replaced with Vpp. FIG. 12 illustrates the waveforms corresponding to one repetition period Tf. The operation during one repetition period Tf of the X and Y electrode driving circuits 95*e*, 96*e*for generating the X and Y sustain pulse waveforms, respectively, differs from the X and Y electrode driving circuits 95*d*, 96*d* of Example 1 of Embodiment 2, in that, in FIG. 12, during a newly provided period T7, the switch Sxc is turned OFF, and the switch Sxf is turned ON, and during a newly provided period T8, the switch Syc is turned OFF, and the switch Syf is turned ON.

With this configuration, during the period T7 corresponding to the period T2 of FIG. 10, instead of Vs, the voltage superimposed with Vpp, i.e. Vs+Vpp, is applied to the node N1, that is, the X electrode, and during the period T8 corresponding to the period T5 of FIG. 10, instead of (−Vs), the voltage superimposed with (−Vpp), i.e. (−Vs−Vpp), is applied to the node N1, that is, the Y electrode. With this, for a large image display load factor, repetition of stable discharges can be realized by accumulating many wall charges after discharge. For a small load factor, by using the same waveforms as in the case of FIG. 8, stable driving can be realized for various image display load factors.

Embodiment 3

Figure 13:
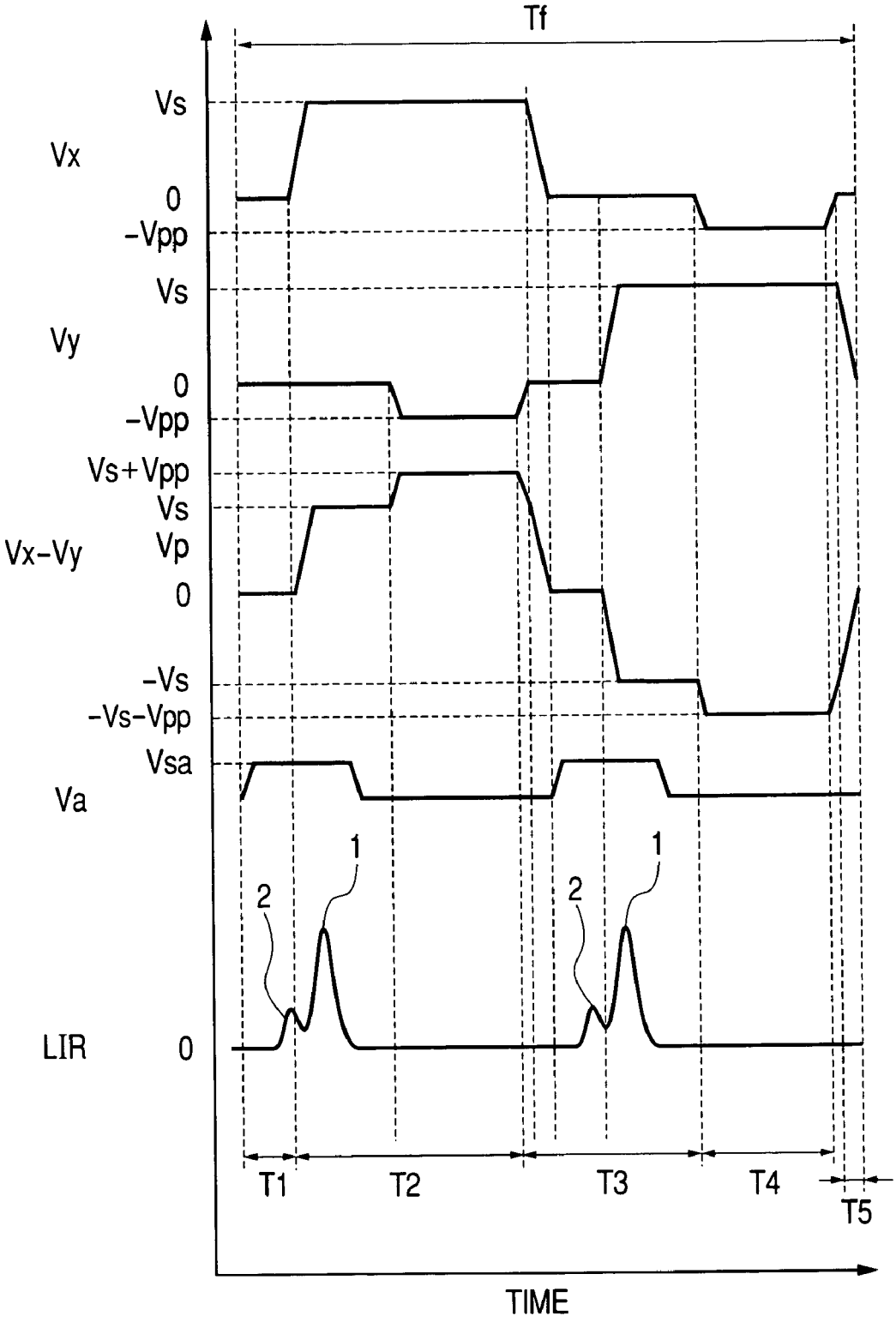
FIG. 13 is a time chart illustrating voltages, a light emission waveform, and input signals to switches during a sustain period in a plasma display device of Embodiment 3 in accordance with the present invention.

FIG. 13 is a time chart illustrating sustain pulse voltage waveforms Vx, Vy applied to all the X and Y electrodes, respectively, simultaneously, an address pulse waveform (Va), a light emission waveform LIR during the sustain period 81 (see FIG. 18A) in a plasma display device of Embodiment 3 in accordance with the present invention.

A driving method of applying a address pulse voltage during the sustain period as shown in FIG. 13 is called an address-modulation driving method. On the other hand, a sustain-modulation driving method is a driving method which uses a sustain waveform providing an intermediate voltage in a sustain pulse waveform as shown in Embodiments 1 and 2.

In the address-modulation driving method shown in FIG. 13, applied to an address electrode during the sustain discharge is a pulse voltage which rises in synchronism with a sustain pulse during sustain-pulse-open periods (~T1 , ~T3). For example, during the sustain-pulse-open period (~T1), a voltage Vsa with respect to a Y electrode having a negative wall voltage due to discharge by a previous sustain pulse is applied to an address electrode, and consequently, a voltage higher than the discharge start voltage is applied between the Y and X electrodes, and thereby a discharge is started between the Y and X electrodes. Soon after, the discharge changes to that between the X and Y electrodes because of the priming effects. This is represented by a peak 2 of the light emission waveform produced by the pre-discharge shown in FIG. 13. Thereafter the Voltage Vx rises to Vs, and thereby a peak 1 of an essential discharge, i.e. the main discharge occurs. The principle of increasing of the luminous efficacy is the same as in the case of Embodiments 1 and 2, and therefore its explanation is omitted. A voltage (−Vpp) is applied to the Y and X electrodes after the discharges during the periods T2 and T4 to stabilize the discharges for displaying images at large load factors. As a result, after the discharges, a voltage (Vs+Vpp) is applied between the X and Y electrodes, and many wall charges can be accumulated. For a load factor below a specified value, a waveform which is not superimposed with Vpp is utilized, and for a load factor not smaller than the specified value, the waveform shown in FIG. 13. Further, a method can be employed which accumulates wall charges after discharge by lengthening the repetition period Tf, for example. Further, for a load factor not smaller than a specified value, Vs may be increased, Va may be increased. Further, a combination of the above may be employed. As described above, in the address-modulation driving method featuring high luminous efficacy, stable discharge can be realized in displaying images at various load factors.

The present invention is not limited to the above embodiments, but includes various combinations of the above-described configurations. In brief, the gist of the present invention is provision of a voltage drop compensating means for compensating for an increase in voltage drop due to an increase in discharge current when a load factor is increased, in the two-step discharge driving method including the sustain discharge driving method and address discharge driving method. The voltage drop compensating means can be configured so as to accumulate many wall charges after the start of discharge by one sustain pulse, or after the discharge. Sustain pulse waveforms may be selected from among at least two kinds of sustain pulse waveforms according to a load factor. At load factors (lighted-discharge-cell ratios) at the boundary between two different driving voltage waveforms, the two luminances produced by the discharges generated by the two waveforms may be made approximately equal to each other.

As described above, the driving method according to the present invention improves the luminous efficacy compared with the conventional driving method, and makes possible stable driving for displaying images at various load factors.

Further, it is needless to say that all the possible combinations of the above examples of the above embodiments can be practiced as the present invention.

The above embodiments have been explained by focusing on the two-step discharge driving method, and the plasma display device can be configured to apply the sustain pulse voltages between the sustain electrode pairs of plural discharge cells to generate sustain discharges in a respective one of the following operating modes selected based upon use of the plasma display device:

(a) generating a pre-discharge and then generating a main discharge;

(b) generating a main discharge without a pre-discharge preceding the main discharge; and (c) switching between the mode (a) and the mode (b).

The present invention has been explained concretely based upon the various embodiments, but the present invention is not limited to the above-explained embodiments, and it is needless to say that various changes and modifications may be made to those without departing from the spirit of the invention.

The present invention provides the plasma display device capable of improving its luminous efficacy and stable driving for displaying images at various load factors.

What is claimed is:

1. A plasma display device comprising a plasma display panel including at least a plurality of discharge cells each having at least an electrode pair for generating a sustain discharge for a light emission display, wherein a sustain pulse voltage, which is applied between said electrode pair in a respective one of said plurality of discharge cells to generate the sustain discharge, comprises at least a first-waveform voltage and a second-waveform voltage, and said first-waveform voltage is composed of one of (1) a combination of a first portion having a major portion of a first voltage and a second portion having a major portion of a second voltage higher than said first voltage and (2) a second portion having a major portion of said second voltage, said second-waveform voltage is composed of a third portion having a major portion of a third voltage and a fourth portion having a major portion of a fourth voltage higher than said third voltage, said first-waveform voltage and said second-waveform voltage satisfy the following conditions (i) and (ii):

(i) at least one of the following inequalities is satisfied: said third voltage>said first voltage, or a time duration of said third portion, T3 (T3>0), >a time duration of said first portion, T1 (T1>0), when said first-waveform voltage is composed of said combination, and (ii) at least one of the following inequalities is satisfied: said fourth voltage>said second voltage, or a time duration of said fourth portion, T4 (T4>0), >a time duration of said second portion, T2 (T2>0), and wherein said first and third voltages are established by applying a power supply voltage and ground potential to electrodes composing the electrode pair.

2. The plasma display device according to claim 1:

wherein two electrodes of said sustain electrode pair are supplied with two voltages opposite in polarity from each other, respectively.

3. The plasma display device according to claim 1, wherein a repetition period of said second-waveform is longer than that of said first-waveform.

4. The plasma display device according to claim 1, wherein said first-waveform and second-waveform voltages include post-discharge voltages higher than said second and fourth voltages, respectively, and succeeding said second portion and said fourth portion, respectively.

5. The plasma display device according to claim 1, wherein at least one of the sustain discharges generated by the first-waveform and the second-waveform occurs at least twice consecutively.

6. The plasma display device according to claim 1, wherein said one of said first-waveform and second-waveform voltages is selected based upon load factor, which is a ratio of a number of lighted ones of said plurality of discharge cells during said sustain discharge to a total number of said plurality of discharge cells.

7. The plasma display device according to claim 6, wherein when T1=0, said sustain pulse voltage is switched from the first-waveform to the second-waveform when said load factor exceeds a predetermined value.

8. The plasma display device according to claim 6, wherein said plasma display device further comprises a table listing a relationship among said load factors, numbers of said sustain pulses of said first-waveform and second-waveform voltages, and luminance of said discharge cells, and at a boundary load factor at which a changeover is performed from said first-waveform voltage to said second-waveform voltage, numbers of sustain pulses of said first-waveform and second-waveform voltages are selected by using said table such that two luminances produced by discharges generated by said first-waveform and second-waveform voltages, respectively, are approximately equal to each other.

9. A plasma display device comprising a plasma display panel including at least a plurality of discharge cells each having at least an electrode pair for generating a sustain discharge for a light emission display and an address electrode for selecting one to be lighted from among said plurality of discharge cells, wherein said address electrode is supplied with an address pulse voltage which rises in a sustain-pulse-open period during which said electrode pair is not supplied with a voltage equal to or higher than a predetermined voltage, and when a load factor, which is a ratio of a number of lighted ones of said plurality of discharge cells during said sustain discharge to a total number of said plurality of discharge cells, exceeds a predetermined value, the sustain pulse voltage is increased, the address pulse voltage is increased or a period of the sustain pulse is lengthened.

10. The plasma display device according to claim 9, wherein said plasma display device further comprises a circuit for calculating said load factor and a control circuit for controlling said address pulse voltage based upon said load factor.

11. The plasma display device according to claim 10, wherein said plasma display device further comprises a table listing a relationship among said load factors, numbers of said sustain pulses of said sustain pulse voltage, said address voltage and luminance of said discharge cells, and at a boundary load factor at which a changeover is performed in said address voltage, said address voltages are selected by using said table such that two luminances produced by discharges generated by said address voltages before and after said changeover, respectively, are approximately equal to each other.

12. The plasma display device according to claim 9, wherein the sustain pulse voltage comprises a first-waveform voltage and a second-waveform voltage, and said first-waveform voltage is composed of a first portion having a major portion of a first voltage and a second portion having a major portion of a second voltage higher than said first voltage, said second-waveform voltage is composed of a third portion having a major portion of a third voltage and a fourth portion having a major portion of a fourth voltage higher than said third voltage, said first-waveform voltage and said second-waveform voltage satisfy the following conditions (i) and (ii):

(i) at least one of the following inequalities is satisfied: said third voltage>said first voltage, or a time duration of said third portion, T3 (T3>0), >a time duration of said first portion, T1 (T1≧0), and (ii) at least one of the following inequalities is satisfied: said fourth voltage>said second voltage, or a time duration of said fourth portion, T4 (T4>0), >a time duration of said second portion, (T2>0).

13. The plasma display device according to claim 12, wherein a repetition period of said second-waveform is longer than that of said first-waveform.

14. A plasma display device according to claim 12, wherein when T1=0, said sustain pulse voltage is switched from the first waveform to the second waveform when said load factor exceeds a predetermined value.

15. A plasma display device comprising a plasma display panel including at least a plurality of discharge cells each having at least an electrode pair for generating a sustain discharge for a light emission display, wherein a sustain pulse voltage, which is applied between said electrode pair in a respective one of said plurality of discharge cells to generate the sustain discharge, comprises composed of a first portion having a major portion of a first voltage and a second portion having a major portion of a second voltage higher than said first voltage, and said first voltage is established by using an inductance coupled to ground potential without having a condenser coupled therebetween.

16. The plasma display device according to claim 15, wherein the sustain pulse voltage further comprises a second-waveform voltage, which is composed of a third portion having a major portion of a third voltage and a fourth portion having a major portion of a fourth voltage higher than said third voltage, and said first-waveform voltage and said second-waveform voltage satisfy the following conditions (i) and (ii):

(i) at least one of the following inequalities is satisfied: said third voltage>said first voltage, or a time duration of said third portion, T3 (T3>0), >a time duration of said first portion, T1 (T1≧0), and (ii) at least one of the following inequalities is satisfied: said fourth voltage>said second voltage, or a time duration of said fourth portion, T4 (T4>0), >a time duration of said second portion, T2 (T2>0).

17. The plasma display device according to claim 16, wherein one of said first-waveform and second-waveform voltages is selected based upon said load factor, which is a ratio of a number of lighted ones of said plurality of discharge cells during said sustain discharge to a total number of said plurality of discharge cells.

18. A plasma display device according to claim 17, wherein when T1=0, said sustain pulse voltage is switched from the first-waveform to the second-waveform when said load factor exceeds a predetermined value.

19. The plasma display device according to claim 16, wherein at least one of the sustain discharges generated by the first-waveform and the second-waveform occurs at least twice consecutively.

20. The plasma display device according to claim 16, wherein said first-waveform and second-waveform voltages include post-discharge voltages higher than said second and fourth voltages, respectively, and succeeding said second portion and said fourth portion, respectively.

21. The plasma display device according to claim 16, wherein a repetition period of said second-waveform is longer than that of said first-waveform.

22. The plasma display device according to claim 17, wherein said plasma display device further comprises a table listing a relationship among said load factors, numbers of said sustain pulses of said first-waveform and second-waveform voltages, and luminance of said discharge cells, and at a boundary load factor at which a changeover is performed from said first-waveform voltage to said second-waveform voltage, numbers of sustain pulses of said first-waveform and second-waveform voltages are selected by using said table such that two luminances produced by discharges generated by said first-waveform and second-waveform voltages, respectively, are approximately equal to each other.

23. The plasma display device according to claim 15, wherein two electrodes of said sustain electrode pair are supplied with two voltages opposite in polarity from each other, respectively.

24. A plasma display device comprising:

a plasma display panel including at least a plurality of discharge cells each having at least an electrode pair for generating a sustain discharge for a light emission display; and a power recovery circuit including a first inductance, wherein a sustain pulse voltage, which is applied between said electrode pair in a respective one of said plurality of discharge cells to generate the sustain discharge, comprises at least a first-waveform composed of a first portion having a major portion of a first voltage and a second portion having a major portion of a second voltage higher than said first voltage wherein said first voltage is established by using a second inductance.

* * * * *